US010161196B2

(12) United States Patent
Kirkhope

(10) Patent No.: US 10,161,196 B2
(45) Date of Patent: Dec. 25, 2018

(54) INDIVIDUALLY VARIABLY CONFIGURABLE DRAG MEMBERS IN AN ANTI-ROTATION DEVICE

(71) Applicant: HALLIBURTON ENERGY SERVICES, INC., Houston, TX (US)

(72) Inventor: Kennedy J. Kirkhope, Nisku (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 156 days.

(21) Appl. No.: 15/111,586

(22) PCT Filed: Feb. 14, 2014

(86) PCT No.: PCT/US2014/016573

§ 371 (c)(1),
(2) Date: Jul. 14, 2016

(87) PCT Pub. No.: WO2015/122917

PCT Pub. Date: Aug. 20, 2015

(65) Prior Publication Data

US 2016/0356099 A1 Dec. 8, 2016

(51) Int. Cl.
*E21B 17/10* (2006.01)
*E21B 7/06* (2006.01)
(Continued)

(52) U.S. Cl.
CPC ..... *E21B 17/1014* (2013.01); *E21B 4/04* (2013.01); *E21B 4/16* (2013.01); *E21B 7/062* (2013.01);
(Continued)

(58) Field of Classification Search
CPC ..... E21B 7/062; E21B 17/1057
See application file for complete search history.

(56) References Cited

U.S. PATENT DOCUMENTS 3,196,959 A 7/1965 Kammerer
3,824,437 A 7/1974 Blaschke
(Continued)

FOREIGN PATENT DOCUMENTS

GB 2172325 9/1986
GB 2230288 10/1990
(Continued)

OTHER PUBLICATIONS

OnePetro, "Downhole Steering Automation and New Survey Measurement Method Significantly Improves High-Dogleg Rotary-Steerable System Performance", http://www.onepetro.org/mslib/app/Preview.do?paperNumber=SPE-166165-MS&societyCode=SPE, 2013, Society of Petroleum Engineers, pp. 2.
(Continued)

*Primary Examiner* — Shane Bomar
(74) *Attorney, Agent, or Firm* — Polsinelli PC

(57) ABSTRACT

Variably configurable anti-rotation device (252) in a rotary steerable subterranean drill (20). The rotary steerable subterranean drill (20) includes a housing (46) with which the anti-rotation device (252) is associated. Wellbore engaging portions of the anti-rotation device (252) are positioned at an exterior (52) of the housing (46) and have a plurality of differently configurable, radially deployable drag members (254) that are peripherally spaced about the exterior (52) of the housing (46). A controller is coupled to the plurality of drag members (254) and is configured to instruct different deployed configurations of at least two of the drag members (254) in dependence upon a controller-determined formation force experienced on a toolface of a drill bit (22) of the rotary steerable subterranean drill (20).

19 Claims, 28 Drawing Sheets

(51) Int. Cl.

| | |
|---|---|
| ***E21B 4/04*** | (2006.01) |
| ***E21B 4/16*** | (2006.01) |
| ***E21B 47/00*** | (2012.01) |
| ***E21B 47/024*** | (2006.01) |

(52) U.S. Cl.
CPC ..... *E21B 47/0006* (2013.01); *E21B 47/024* (2013.01)

(56) References Cited

U.S. PATENT DOCUMENTS

| | | | |
|---|---|---|---|
| 4,299,296 | A | 11/1981 | Geczy |
| 4,324,297 | A | 4/1982 | Denison |
| 4,394,881 | A | 7/1983 | Shirley |
| 4,407,377 | A | 10/1983 | Russell |
| 4,445,578 | A | 5/1984 | Millheim |
| 4,476,943 | A | 10/1984 | Williams |
| 4,491,187 | A | 1/1985 | Russell |
| 4,662,458 | A | 5/1987 | Ho |
| 4,739,841 | A | 4/1988 | Das |
| 4,754,821 | A | 7/1988 | Swietlik |
| 4,821,563 | A | 4/1989 | Maron |
| 4,947,944 | A | 8/1990 | Coltman et al. |
| 4,958,517 | A | 9/1990 | Maron |
| 5,168,941 | A | 12/1992 | Krueger et al. |
| 5,220,963 | A | 6/1993 | Patton |
| 5,265,684 | A | 11/1993 | Rosenhauch |
| 5,293,945 | A | 3/1994 | Rosenhauch et al. |
| 5,368,110 | A | 11/1994 | French |
| 5,386,724 | A | 2/1995 | Das et al. |
| 5,421,421 | A | 6/1995 | Appleton |
| 5,467,834 | A | 11/1995 | Hughes et al. |
| 5,547,031 | A | 8/1996 | Warren et al. |
| 5,608,162 | A | 3/1997 | Ho |
| 5,685,379 | A | 11/1997 | Barr et al. |
| 5,720,355 | A | 2/1998 | Lamine et al. |
| 5,931,239 | A | 8/1999 | Schuh |
| 6,068,394 | A | 5/2000 | Dublin |
| 6,082,457 | A | 7/2000 | Best et al. |
| 6,092,610 | A | 7/2000 | Kosmala et al. |
| 6,158,529 | A | 12/2000 | Dorel |
| 6,227,313 | B1 | 5/2001 | Davis et al. |
| 6,233,524 | B1 | 5/2001 | Harrell et al. |
| 6,244,361 | B1 | 6/2001 | Comeau et al. |
| 6,321,857 | B1 | 11/2001 | Eddison |
| 6,328,119 | B1 | 12/2001 | Gills et al. |
| 6,415,878 | B1 | 6/2002 | Cargill et al. |
| 6,550,548 | B2 | 4/2003 | Taylor |
| 6,769,499 | B2 | 8/2004 | Cargill et al. |
| 6,840,336 | B2 | 1/2005 | Schaag et al. |
| 7,036,580 | B2 | 5/2006 | McGarian et al. |
| 7,147,066 | B2 | 12/2006 | Chen et al. |
| 7,216,726 | B2 | 5/2007 | Swietlik et al. |
| 7,306,058 | B2 | 12/2007 | Cargill et al. |
| 7,306,060 | B2 | 12/2007 | Krueger et al. |
| 7,413,032 | B2 | 8/2008 | Krueger |
| 7,413,034 | B2 | 8/2008 | Kirkhope et al. |
| 7,426,967 | B2 | 9/2008 | Sugiura |
| 7,445,060 | B2 | 11/2008 | Stroud et al. |
| 7,464,770 | B2 | 12/2008 | Jones et al. |
| 7,467,673 | B2 | 12/2008 | Earles et al. |
| 7,481,282 | B2 | 1/2009 | Horst et al. |
| 7,588,082 | B2 | 9/2009 | Lasater |
| 7,637,321 | B2 | 12/2009 | Zazovsky et al. |
| 7,685,732 | B2 | 3/2010 | Davis et al. |
| 7,703,550 | B2 | 4/2010 | Nevlud et al. |
| 7,735,581 | B2 | 6/2010 | Beylotte et al. |
| 7,762,356 | B2 | 7/2010 | Turner et al. |
| 7,775,099 | B2 | 8/2010 | Bogath et al. |
| 7,798,253 | B2 | 9/2010 | Schuh |
| 7,950,473 | B2 | 5/2011 | Sugiura |
| 7,967,081 | B2 | 6/2011 | Sugiura |
| 8,118,114 | B2 | 2/2012 | Sugiura |
| 8,191,651 | B2 | 6/2012 | Hall et al. |
| 8,286,733 | B2 | 10/2012 | Tulloch et al. |
| 8,302,703 | B2 | 11/2012 | Rolovic |
| 8,360,172 | B2 | 1/2013 | Santelmann |
| 8,453,765 | B2 | 6/2013 | Haughom |
| 8,484,858 | B2 | 7/2013 | Brannigan et al. |
| 8,534,380 | B2 | 9/2013 | Sheppard et al. |
| 8,627,901 | B1 * | 1/2014 | Underwood ..... E21B 7/14 175/107 |
| 2002/0185314 | A1 | 12/2002 | Cargill et al. |
| 2004/0188142 | A1 * | 9/2004 | Self ..... E21B 7/046 175/53 |
| 2005/0098353 | A1 * | 5/2005 | Maxwell ..... E21B 17/1014 175/57 |
| 2006/0254825 | A1 * | 11/2006 | Krueger ..... E21B 7/062 175/61 |
| 2007/0188742 | A1 | 8/2007 | Gunsaulis |
| 2008/0190665 | A1 * | 8/2008 | Earles ..... E21B 7/06 175/24 |
| 2009/0044980 | A1 * | 2/2009 | Sheppard ..... E21B 7/06 175/24 |
| 2009/0145666 | A1 * | 6/2009 | Radford ..... E21B 10/30 175/269 |
| 2009/0166086 | A1 * | 7/2009 | Sugiura ..... E21B 7/062 175/25 |
| 2009/0266616 | A1 | 10/2009 | Finkenzeller |
| 2010/0126770 | A1 | 5/2010 | Sugiura |
| 2011/0240368 | A1 | 10/2011 | Allen et al. |
| 2011/0259645 | A1 | 10/2011 | Tulloch et al. |
| 2012/0046865 | A1 | 2/2012 | Heisig et al. |
| 2012/0055327 | A1 | 3/2012 | Holowczak |
| 2012/0061099 | A1 | 3/2012 | Wold et al. |
| 2012/0285746 | A1 | 11/2012 | Kvalvik |
| 2013/0146363 | A1 | 6/2013 | Haughom |

FOREIGN PATENT DOCUMENTS

| | | |
|---|---|---|
| GB | 2425791 | 11/2006 |
| WO | 9008245 | 7/1990 |
| WO | 12162833 | 12/2012 |

OTHER PUBLICATIONS

Kapoh, Oddy, New Locking Clutch Turbine Technology Successfully Frees Stuck Bit/BHA in Deep Gas Wells Oman, 2011.

Warren, Tommy; Slimhole rotary steerable system broadens applications; Sep. 1997.

Weatherford; Revolutionizing drilling efficiency in all types of environments, 2009.

Rotary Steerable System; (http://www.bakerhughes.com/products-and-services/drilling/drill-bit-systems) published on Jan. 11, 2010, pp. 4.

Oil and Gas Journal , "Rotary Steerable System Replaces Slide Mode for Directional Drilling Applications", http://www.pgj.com/articles/print/volume-96/issue-9/in-this-issue/general-interest/rotary-steerable-system-replaces-slide-mode-f.html ; published on Mar. 2, 1998, pp. 3.

Clegg, Barr.; Steerable Rotary Drilling with an Experimental System, https://www.onepetro.org/, 1995, pp. 2.

OnePetro, "Coupling of Downhole Dynamics Recorder Enhance System-Matched Approach to Drill Bit Design and Application with a Specific Rotary Steerable System." http://www.onepetro.org/mslib/servlet/onepetropreview?id=SPE-102182-MS; 2006, pp. 2.

OnePetro, "The First OffShore Use of an Ultra High Speed Drilling Telemetry Network Involving a Full LWD Logging Suite and Rotary Steerable Drilling System", http://www.onepetro.org/mslib/servlet/onepetropreview?id=SPE-110939-MS Nov. 7, 2007, pp. 2.

OnePetro, "Integrated Approach to Rotary-Steerable Drilling Optimization using Concurrent Real-Time measurement of Near-bit Borehole Caliper and Near-bit Vibration.", http://www.onepetro.org/mslib/servlet/onepetropreview?id=SPE-112163-MS, 2008, pp. 2.

Schlumberger; PowerDrive vorteX Powered Rotary Steerable System; http://www.slb.com/services/drilling/directional_drilling/powerdrive_family/powerdrive_vortex.aspx; 2013 Schlumberger Limited and retrieved Nov. 7, 2013, pp. 2.

(56) References Cited

OTHER PUBLICATIONS

OnePetro; "Real-Time BHA Bending Information Reduces Risk when Drilling Hard Interbedded BHA Bending Information Reduces Risk when Drilling Hard Interbedded Formations." http://www.onepetro.org/mslib/app/Preview.do?paperNumber=00079918&societyCode=SPE, 2003, pp. 2.

OnePetro, "The Use of the Industry's First 3-D Mechanical Caliper Image While Drilling Leads to Optimized Rotary-Steerable Assemblies in Push- and Point-the-Bit Configurations", http://www.onepetro.org/mslib/app/Preview.do?paperNumber=SPE-115395-MS&societyCode=SPE, 2008. Society of Petroleum Engineers, pp. 2.

International Search Report and Written Opinion; PCT Application No. PCT/US2014/016573; dated Nov. 20, 2014.

International Preliminary Report on Patentability; PCT Application No. PCT/US2014/016573; dated May 16, 2016.

* cited by examiner

INDIVIDUALLY VARIABLY CONFIGURABLE DRAG MEMBERS IN AN ANTI-ROTATION DEVICE

CROSS-REFERENCE TO RELATED APPLICATIONS

This application is a national stage entry of PCT/US2014/016573 filed Feb. 14, 2014, said application is expressly incorporated herein in its entirety.

FIELD

The present disclosure relates generally to drilling systems, and particularly to rotary steerable drilling systems for oil and gas exploration and production operations. More specifically, the present disclosure relates to a variably configurable anti-rotation device capable of being used to counteract a formation force acting on the toolface of a drill bit during rotary steerable drilling.

BACKGROUND

Directional drilling in oil exploration and production is used to reach subterranean destinations or formations with a rotating drill string. One type of directional drilling involves rotary steerable drilling systems. Rotary steerable drilling systems use the rotary power of the drill string for drilling, while at the same time steering an attached rotating drill bit toward a desired target location in a subterranean formation. These steering systems typically include a housing that is rotationally fixed in the borehole, a drilling shaft that is rotatably supported in the housing, and additional components that orient the drill bit relative to the housing, and bias the bit in the desired drilling direction into the formation.

In order to prevent, or at least impede rotation of the housing, anti-rotation devices are employed on the rotary steerable drill that press against the formation in order to resist rotation of the housing in the wellbore.

BRIEF DESCRIPTION OF THE DRAWINGS

Implementations of the present technology will now be described, by way of example only, with reference to the attached figures, wherein.

DETAILED DESCRIPTION

Figure 1:
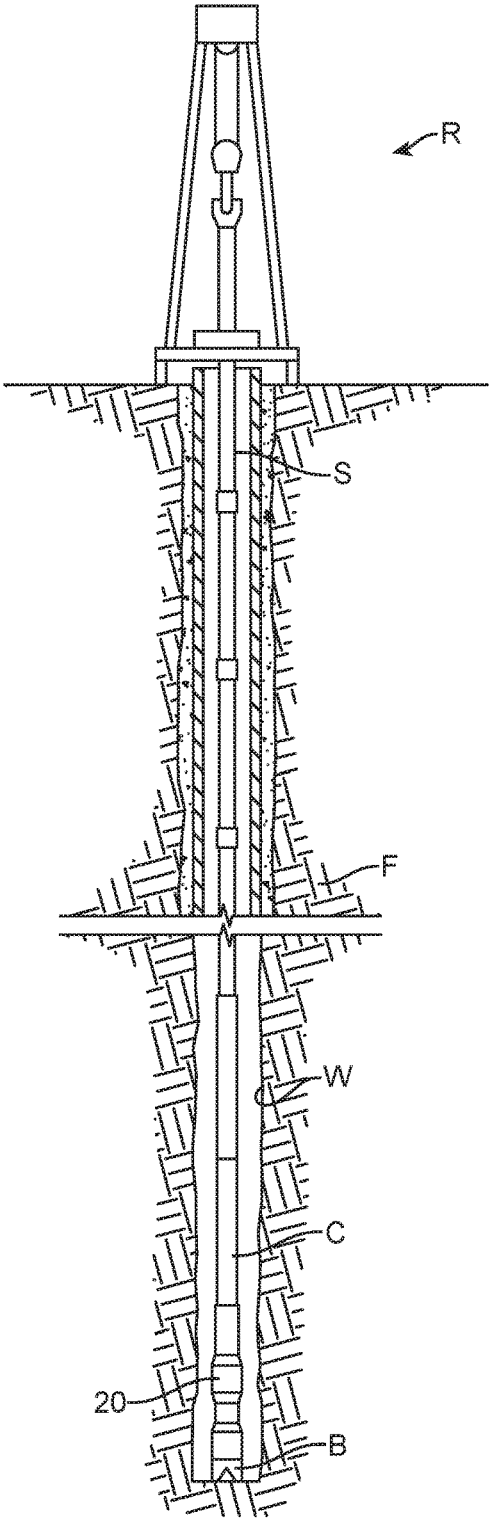
FIG. 1 is a partial cross-section view illustrating an embodiment of a drilling rig for drilling a wellbore using a rotary steerable drilling system in accordance with the principles of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially refers to the longer axis of the object.

Disclosed herein is a rotary steerable subterranean drill capable of establishing a deflection angle and azimuthal toolface direction of a drill bit. The rotary steerable subterranean drill includes a housing, together with an integrated anti-rotation device(s). The anti-rotation device is positioned at an exterior of the housing and has a plurality of differently configurable, radially deployable drag members that are peripherally spaced about the exterior of the housing. A controller is communicatively coupled to the plurality of drag members and is configured to instruct different deployed configurations of at least two of the drag members in dependence upon a controller-determined formation force experienced on a toolface of a drill bit during rotary steerable drilling.

Drill String and Rotary Steering Device

FIG. 1 of the drawings illustrates a drill string, indicated generally by the reference letter S, extending from a conventional rotary drilling rig R and in the process of drilling a wellbore W into an earth formation F. The lower end portion of the drill string S includes a drill collar C, and a drill tool or bit B at the end of the string S, and a rotary steerable drilling device (20) discussed further below. The drill bit B may be in the form of a roller cone bit or fixed cutter bit or any other type of bit known in the art. In certain configurations, the wellbore W is drilled by rotating the drill string S, and therefore the drill bit B, from the rig R in a conventional manner. Those skilled in the art will appreciate that these components are recited as illustrative for contextual purposes and are not intended to limit the disclosure provided herein.

Also shown in FIG. 1 is an embodiment of a rotary steerable drilling device (20). As shown therein, the rotary drilling device (20) is positioned on the drill string S, before the drill bit B. However, one of skill in the art will recognize that the positioning of the rotary steerable drilling device (20) on the drill string S and relative to other components on the drill string S may be modified while remaining within the scope of the present disclosure.

Figure 2A:
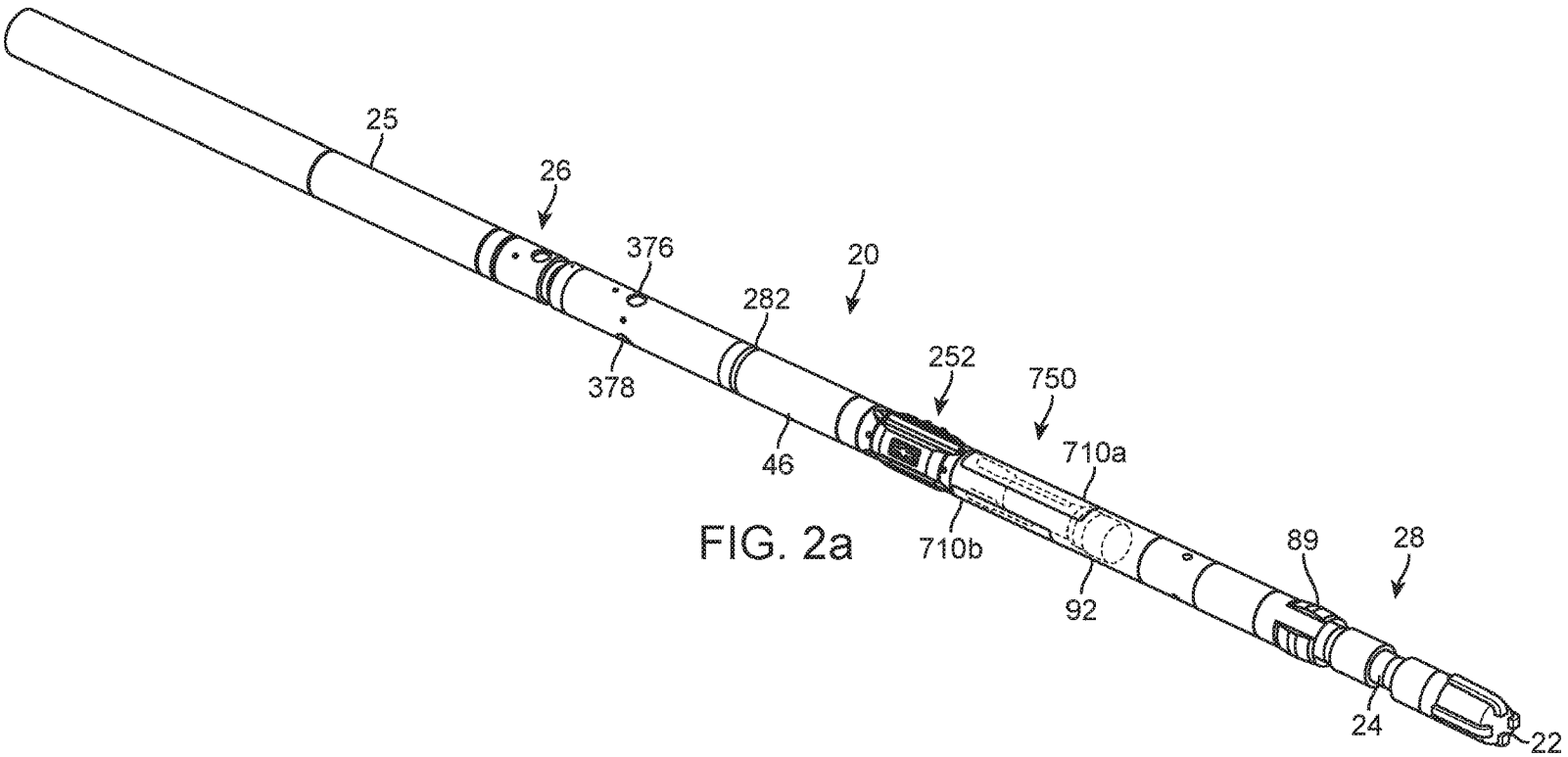
FIG. 2*a* is a perspective view of one embodiment of a rotary steerable drilling device.
Figure 2B:
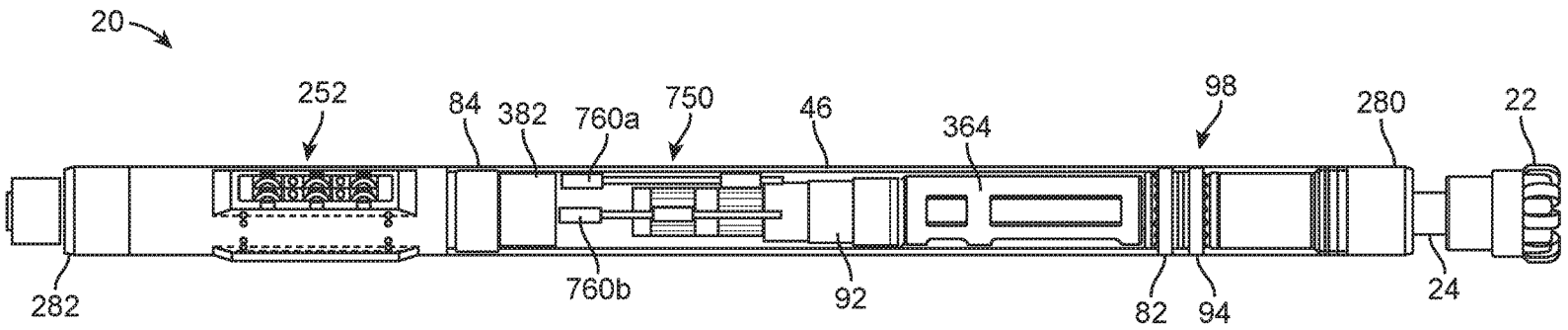
FIG. 2*b* is a side elevational view, partially cut-away, of an embodiment of a rotary steerable drilling device.

An exemplary rotary steerable drilling device (20) is illustrated for example in FIGS. 2*a* and 2*b*. The drilling direction of the rotary steerable drilling device (20) is comprised of a rotatable drilling shaft (24) that is connectable or attachable to a rotary drill bit (22) and to a rotary drill string (25) during drilling operations. More particularly, the drilling shaft (24) has a proximal end (26) closest to the earth's surface and a distal end (28) deepest in the well, furthest from the earth's surface. The proximal end (26) is drivingly connectable or attachable with the rotary drill string (25) such that rotation of the drill string (25) from the surface results in a corresponding rotation of the drilling shaft (24). The proximal end (26) of the drilling shaft (24) may be permanently or removably attached, connected or otherwise affixed with the drill string (25) in any manner and by any structure, mechanism, device or method permitting the rotation of the drilling shaft (24) upon the rotation of the drill string (25). In this regard, a drive connection connects the drilling shaft (24) with the drill string (25). As indicated, the drive connection may be comprised of any structure, mechanism or device for drivingly connecting the drilling shaft (24) and the drill string (25) so that rotation of the drill string (25) results in a corresponding rotation of the drilling shaft (24).

The distal end (28) of the drilling shaft (24) is drivingly connectable or attachable with the rotary drill bit (22) such that rotation of the drilling shaft (24) by the drill string (25) results in a corresponding rotation of the drill bit (22). The distal end (28) of the drilling shaft (24) may be permanently or removably attached, connected or otherwise affixed with the drill bit (22) in any manner and by any structure, mechanism, device or method permitting the rotation of the drill bit (22) upon the rotation of the drilling shaft (24). In the exemplary embodiment, a threaded connection is utilized.

The drilling shaft (24) may be comprised of one or more elements or portions connected, attached or otherwise affixed together in any suitable manner providing a unitary drilling shaft (24) between the proximal and distal ends (26, 28). In some examples, any connections provided between the elements or portions of the drilling shaft (24) are relatively rigid such that the drilling shaft (24) does not include any flexible joints or articulations therein. In one embodiment, the drilling shaft (24) is comprised of a single, unitary or integral element extending between the proximal and distal ends (26, 28). Further, the drilling shaft (24) is tubular or hollow to permit drilling fluid to flow therethrough in a relatively unrestricted and unimpeded manner.

The drilling shaft (24) may be comprised of any material suitable for and compatible with rotary drilling. In one embodiment, the drilling shaft (24) is comprised of high strength stainless steel and is sometimes referred to as a mandrel.

The rotary steerable drilling device (20) is comprised of a housing (46) for rotatably supporting a length of the drilling shaft (24) for rotation therein upon rotation of the attached drill string (25). The housing (46) may support, and extend along any length of the drilling shaft (24). However, in the illustrated example, the housing (46) supports substantially the entire length of the drilling shaft (24) and extends substantially between the proximal and distal ends (26, 28) of the drilling shaft (24). The drilling shaft (24) and the housing (46) can be each substantially cylindrical shaped and have a longitudinal centerline.

The housing (46) may be comprised of one or more tubular or hollow elements, sections or components permanently or removably connected, attached or otherwise affixed together to provide a unitary or integral housing (46) permitting the drilling shaft (24) to extend therethrough.

The rotary steerable drilling device (20) may optionally be further comprised of a near bit stabilizer (89), preferably located adjacent to the distal end of the housing (46). The near bit stabilizer (89) may be comprised of any type of stabilizer and may be either adjustable or non-adjustable.

The distal end comprises a distal radial bearing (82) which comprises a fulcrum bearing, also referred to as a focal bearing, or some other bearing which facilitates the pivoting of the drilling shaft (24) at the distal radial bearing location upon the controlled deflection of the drilling shaft (24) by the rotary steerable drilling device (20) to produce a bending or curvature of the drilling shaft (24).

The rotary steerable drilling device (20) is further comprised of at least one proximal radial bearing (84) which is contained within the housing (46) for rotatably supporting the drilling shaft (24) radially at a proximal radial bearing location defined thereby.

The deflection assembly (92) within the rotary steerable drilling device (20) provides for the controlled deflection of the drilling shaft (24) resulting in a bend or curvature of the drilling shaft (24), as described further below, in order to provide the desired deflection of the attached drill bit (22). The orientation of the deflection of the drilling shaft (24) may be altered in order to change the orientation of the drill bit (22) or toolface, while the magnitude of the deflection of the drilling shaft (24) may also be altered to vary the magnitude of the deflection of the drill bit (22) or the bit tilt relative to the housing (46).

The rotary steerable drilling device (20) can comprise a distal seal or sealing assembly (280) and a proximal seal or sealing assembly (282). The distal seal (280) is radially positioned and provides a rotary seal between the housing (46) and the drilling shaft (24) at, adjacent or in proximity to the distal end of the housing (46). In this way, the housing (46) can be maintained as a compartment or container for the contents located therein. In at least one embodiment, the compartment can be a closed compartment when it is sealed.

The rotary steerable drilling device (20) is comprised of at least one distal thrust bearing (94) at thrust bearing location (98). Thrust bearings may be positioned at any location along the length of the drilling shaft (24) that rotatably support the drilling shaft (24) radially within the housing (46), but resist longitudinal movement of the drilling shaft (24) within the housing (46).

The rotary steerable drilling device (20) optionally has a housing orientation sensor apparatus (364) for sensing the orientation of the housing (46) within the wellbore. The housing orientation sensor apparatus (364) can contain an ABI or At-Bit-Inclination insert associated with the housing (46). Additionally, the rotary steerable drilling device (20) can have a drill string orientation sensor apparatus (376). Sensors which can be employed to determine orientation include for example magnetometers and accelerometers. The rotary steerable drilling device (20) also optionally has a releasable drilling-shaft-to-housing locking assembly (382) which can be used to selectively lock the drilling shaft (24) and deflector housing (46) together. In some situations downhole, it is desired that the shaft (24) not be able rotate relative to the housing (46). One such instance can be if the drilling device (20) gets stuck downhole; in that case it may be desirable to attempt to rotate the housing (46) with the drill string to dislodge the drilling device (2) from the wellbore. In order to do that, the locking assembly (382) is engaged (locked) which prevents the drilling shaft (24) from rotating in the housing (46), and turning the drill string turns the housing (46).

Further, in order that information or data may be communicated along the drill string (25) from or to downhole locations, the rotary steerable drilling device (20) can include a drill string communication system (378). Communications can include wired or wireless, as well as "mud pulse" or any other known or conventional drill string communication device. The drill string communication system (378) may be comprised of any system able to communicate or transmit data or information from or to downhole locations. The drill string communication system (378) can include an MWD or Measurement-While-Drilling system or device.

Deflection Mechanism

There are a number of methods for deflecting and bending the drilling shaft in order to orient or direct the drill bit. One example of the rotary steerable drilling device (20) shown in FIGS. 2*a* and 2*b*, includes a drilling shaft deflection assembly (92) contained within the housing (46) for bending the drilling shaft (24) therein. The drilling shaft deflection assembly (92) is located axially at a location between the distal radial bearing location (82) and the proximal radial bearing location (84) so that the deflection assembly (92) bends (pulls to the side while rotating) the drilling shaft (24) between the distal radial bearing (82) and the proximal radial bearing (86). Various embodiments of the drilling shaft deflection assembly (92) are described in detail below.

The deflection assembly (92) includes a mechanism for imparting lateral movement to the drilling shaft (24). As shown in the exemplary embodiment illustrated in FIG. 3, the deflection mechanism (384) is comprised of a double ring eccentric mechanism. The eccentric rings may be located at a spaced apart distance from one another along the length of the drilling shaft (24). However, in the illustrated example, the deflection mechanism (384) is comprised of an eccentric outer ring (156) and an eccentric inner ring (158), provided one within the other at the same axial location or position along the drilling shaft (24), within the housing (46). Rotation of one or both of the two eccentric rings (156, 158) imparts a controlled deflection of the drilling shaft (24) at the location of the deflection mechanism (384).

The exemplary deflection assembly (92) disclosed herein can be described as a double eccentric drive mechanism. Particularly, the outer ring (156) has a circular outer peripheral surface (160) and defines therein a circular inner peripheral surface (162). The outer ring (156), and preferably the circular outer peripheral surface (160) of the outer ring (156), is rotatably supported by or rotatably mounted on, directly or indirectly, the circular inner peripheral surface (78) of the housing (46). When indirectly supported, there can be included for example an intermediate housing (751) between the outer ring (156) and inner peripheral surface (78) of the housing (46). The portion of the housing (46) which houses the eccentric rings can be referred to as the deflector housing (46). In some embodiments, this housing (46) is cylindrically shaped to accommodate the shape of the outer ring. The circular outer peripheral surface (160) of the outer ring (156) may be supported or mounted on the circular inner peripheral surface (78) by any supporting structure, mechanism or device permitting the rotation of the outer ring (156) relative to the housing (46), such as by a roller bearing mechanism or assembly.

The circular inner peripheral surface (162) of the outer ring (156) is formed and positioned within the outer ring (156) such that it is eccentric with respect to the housing (46). In other words, the circular inner peripheral surface (162) is deviated from the housing (46) to provide a desired degree or amount of deviation.

Figure 3:
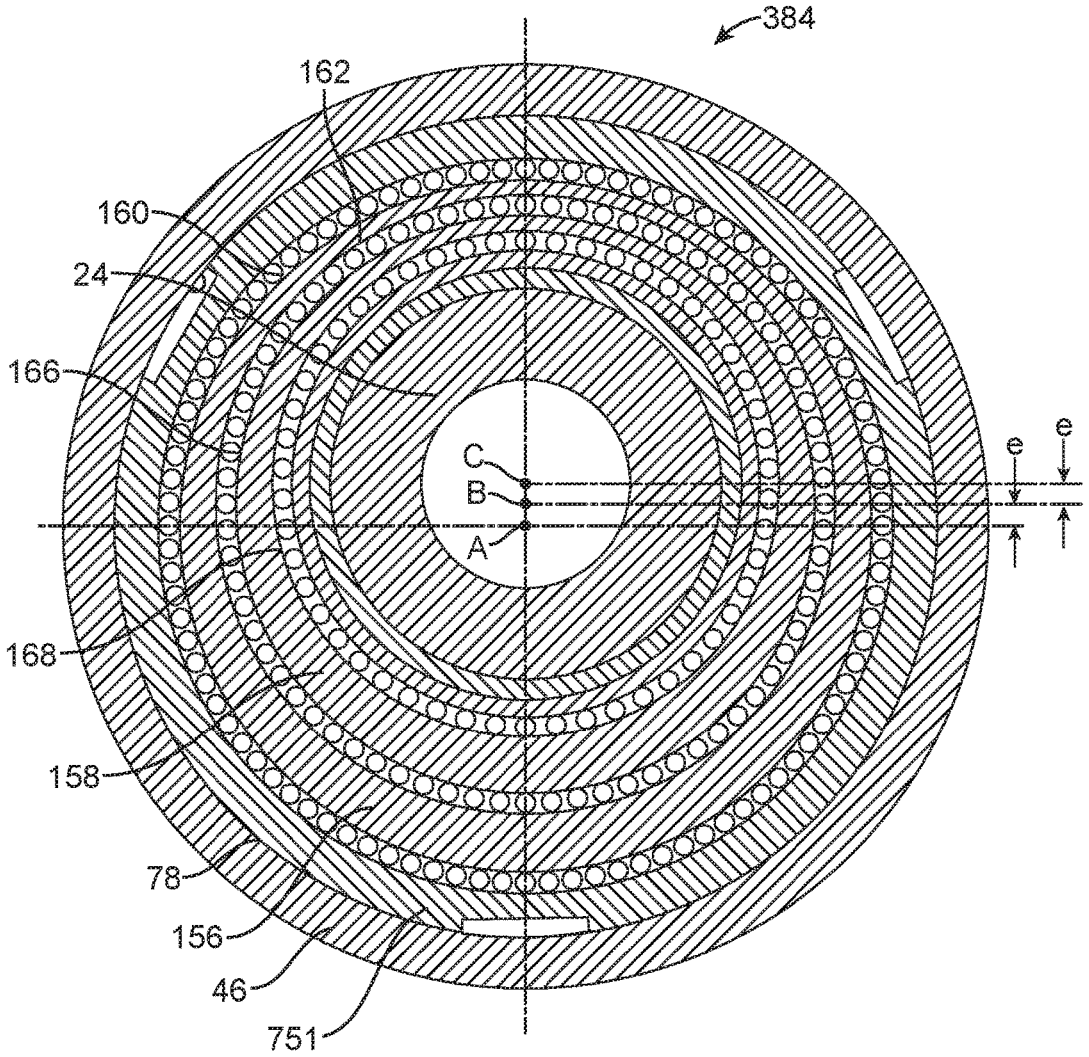
FIG. 3 is a schematic, transverse cross-section view of a drilling shaft deflection assembly of a rotary steerable drilling device, including a rotatable outer eccentric ring and a rotatable inner eccentric ring.

Still referring to FIG. 3, the circular inner peripheral surface (78) of the housing (46) is centered on the center of the drilling shaft (24), or the rotational axis "A" of the drilling shaft (24), when the drilling shaft (24) is in an undeflected condition or the deflection assembly (92) is inoperative. The longitudinal centerlines of the undeflected drilling shaft (24) and housing (46) are substantially coincident when the drilling shaft (24) is undeflected within the housing (46).

The circular inner peripheral surface (162) of the outer ring (156) is centered on point "B" which is offset from the centerlines of the drilling shaft (24) and housing (46) by a distance "e."

Similarly, the inner ring (158) has a circular outer peripheral surface (166) and defines therein a circular inner peripheral surface (168). The inner ring (158), and preferably the circular outer peripheral surface (166) of the inner ring (158), is rotatably supported by or rotatably mounted on, either directly or indirectly, the circular inner peripheral surface (162) of the outer ring (156). The circular outer peripheral surface (166) may be supported by or mounted on the circular inner peripheral surface (162) by any supporting structure, mechanism or device permitting the rotation of the inner ring (158) relative to the outer ring (156), such as by a roller bearing mechanism or assembly.

The circular inner peripheral surface (168) of the inner ring (158) is formed and positioned within the inner ring (158) such that it is eccentric with respect to the circular inner peripheral surface (162) of the outer ring (156). In other words, the circular inner peripheral surface (168) of the inner ring (158) is deviated from the circular inner peripheral surface (162) of the outer ring (156) to provide a desired degree or amount of deviation.

More particularly, the circular inner peripheral surface (168) of the inner ring (158) is centered on point "C", which is deviated from the center "B" of the circular inner peripheral surface (162) of the outer ring (156) by the same distance "e". As described, preferably, the degree of deviation of the circular inner peripheral surface (162) of the outer ring (156) from the housing (46), defined by distance "e", is substantially equal to the degree of deviation of the circular inner peripheral surface (168) of the inner ring (158) from the circular inner peripheral surface (162) of the outer ring (156), also defined by distance "e".

The drilling shaft (24) extends through the circular inner peripheral surface (168) of the inner ring (158) and is thereby rotatably supported. The drilling shaft (24) may be supported by the circular inner peripheral surface (168) by any supporting structure, mechanism or device permitting the rotation of the drilling shaft (24) relative to the inner ring (158), such as by a roller bearing mechanism or assembly.

As a result of the above described configuration, the drilling shaft (24) may be moved, and specifically may be laterally or radially deviated or pulled to the side within the housing (46), upon the movement of the center of the circular inner peripheral surface (168) of the inner ring (158). Specifically, upon the rotation of the inner and outer rings (158, 156), either independently or together, the center of the drilling shaft (24) may be moved with the center of the circular inner peripheral surface (168) of the inner ring (158) and positioned at any point within a circle having a radius equal to the sum of the amounts of deviation of the circular inner peripheral surface (168) of the inner ring (158) and the circular inner peripheral surface (162) of the outer ring (156).

In other words, by rotating the inner and outer rings (158, 156) relative to each other, the center of the circular inner peripheral surface (168) of the inner ring (158) can be moved to any position within a circle having the predetermined or predefined radius as described above. Thus, the portion or section of the drilling shaft (24) extending through and supported by the circular inner peripheral surface (168) of the inner ring (158) can be deflected by an amount in any direction perpendicular to the rotational axis of the drilling shaft (24).

More particularly, since the circular inner peripheral surface (162) of the outer ring (156) has the center B, which is deviated from the rotational center A of an undeflected drilling shaft (24) by the distance "e", the locus of the center B is represented by a circle having a radius "e" around the center A. Further, since the circular inner peripheral surface (168) of the inner ring (158) has the center C, which is deviated from the center B by a distance "e", the locus of the center "C" is represented by a circle having a radius "e" around the center B. As a result, the deviated center C of the drilling shaft (24) may be moved to any desired position within a circle having a radius of "2e" around the center A (see FIG. 3). Accordingly, the portion of the drilling shaft (24) supported by the circular inner peripheral surface (168) of the inner ring (158) can be deflected in any direction on a plane perpendicular to the undeflected rotational axis of the drilling shaft (24) by a distance of up to "2e" (i.e., "e" plus "e"), thus providing for variable positioning of the drilling shaft (24) within the circle having radius 2e. When deflected, the condition is also sometimes referred to as a "Deflection ON" setting.

In addition, as stated, the two deviation distances "e" are preferably substantially similar in order to permit the operation of the rotary steerable drilling device (20) such that the drilling shaft (24) is undeflected within the housing (24) when directional drilling is not required. More particularly, since the degree of deviation of each of the centers B and C of the circular inner peripheral surface (162) of the outer ring (156) and the circular inner peripheral surface (168) of the inner ring (158), respectively, is preferably defined by the same or equal distance "e", the center C of the portion of the drilling shaft (24) extending through the deflection assembly (92) can be positioned on the undeflected rotational axis A of the drilling shaft (24) (i.e., "e" minus "e"), in which case the rotary steerable drilling device (20) is in a zero deflection mode which is sometimes referred to as a "Deflection OFF" setting.

Figure 4:
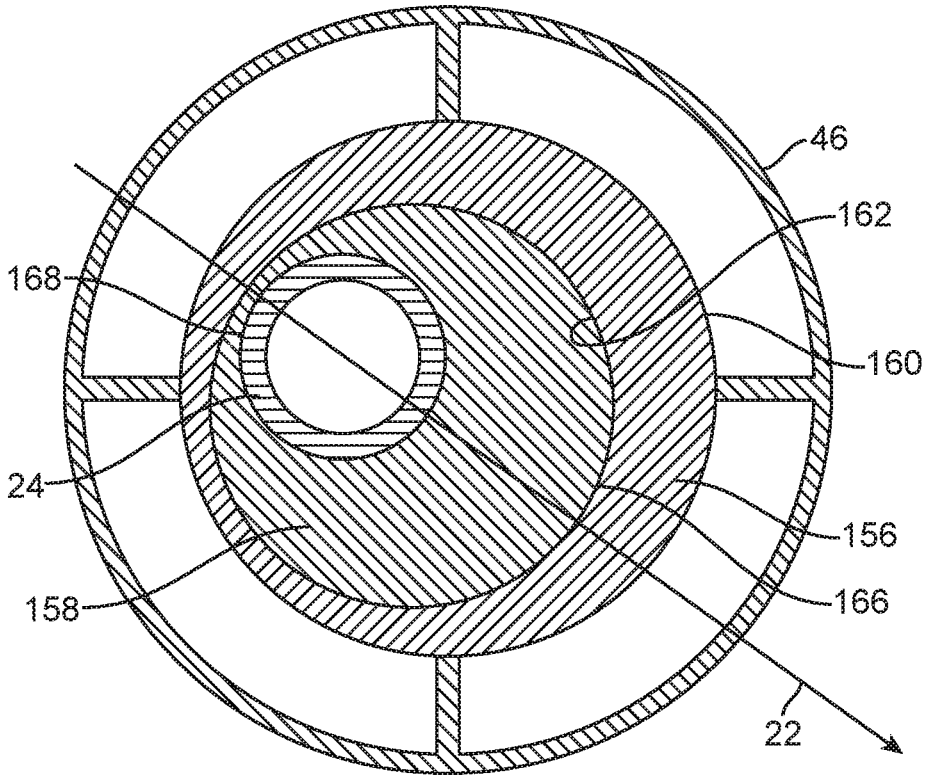
FIG. 4 is a simplified schematic of a transverse cross-section view of the deflection assembly of the drilling shaft deflection assembly that exaggerates the offset position of the drilling shaft relative the housing.

A simplified and exaggerated expression of the drilling shaft (24) deflection concept is illustrated in FIG. 4. As depicted, the orientation of the rings (156, 158) causes deflection of the drilling shaft (24) in one direction thereby tilting the drill bit (22) in the opposite direction relative to the centerline of the deflector housing (46).

This simplified depiction of FIG. 4 more clearly illustrates how actuation of the deflection assembly pulls the drilling shaft (24) to the side within the deflector housing (46) and in this manner deflects or bends the drilling shaft (24) because the shaft (24) is otherwise radially centered and anchored in the housing (46) at both ends of the shaft (24) by the radial distal bearing (82, 84). From this exaggerated perspective in FIG. 4, it is also easier to appreciate the fact that revolution of the deflected shaft around in the housing (46), for instance by rotating the outer ring (156) with the inner ring (158) held fast, causes the bowed (deflected) drilling shaft (24) to orbit about within the housing, resembling a rotating jump-rope. In this way the direction that the lower end of the shaft (24) extends out of the housing (46) is established. This directional extension at the deflected angle establishes a desired toolface orientation of the bit. For example, once the eccentric rings (156, 158) are rotated to create the desired deflection, the rings (156, 158) can be fixed relative to one another and rotated together in order to orient the drill bit (22) in the desired angular direction relative to the housing's (46) centerline.

Powering the Deflection Assembly

Figure 5:
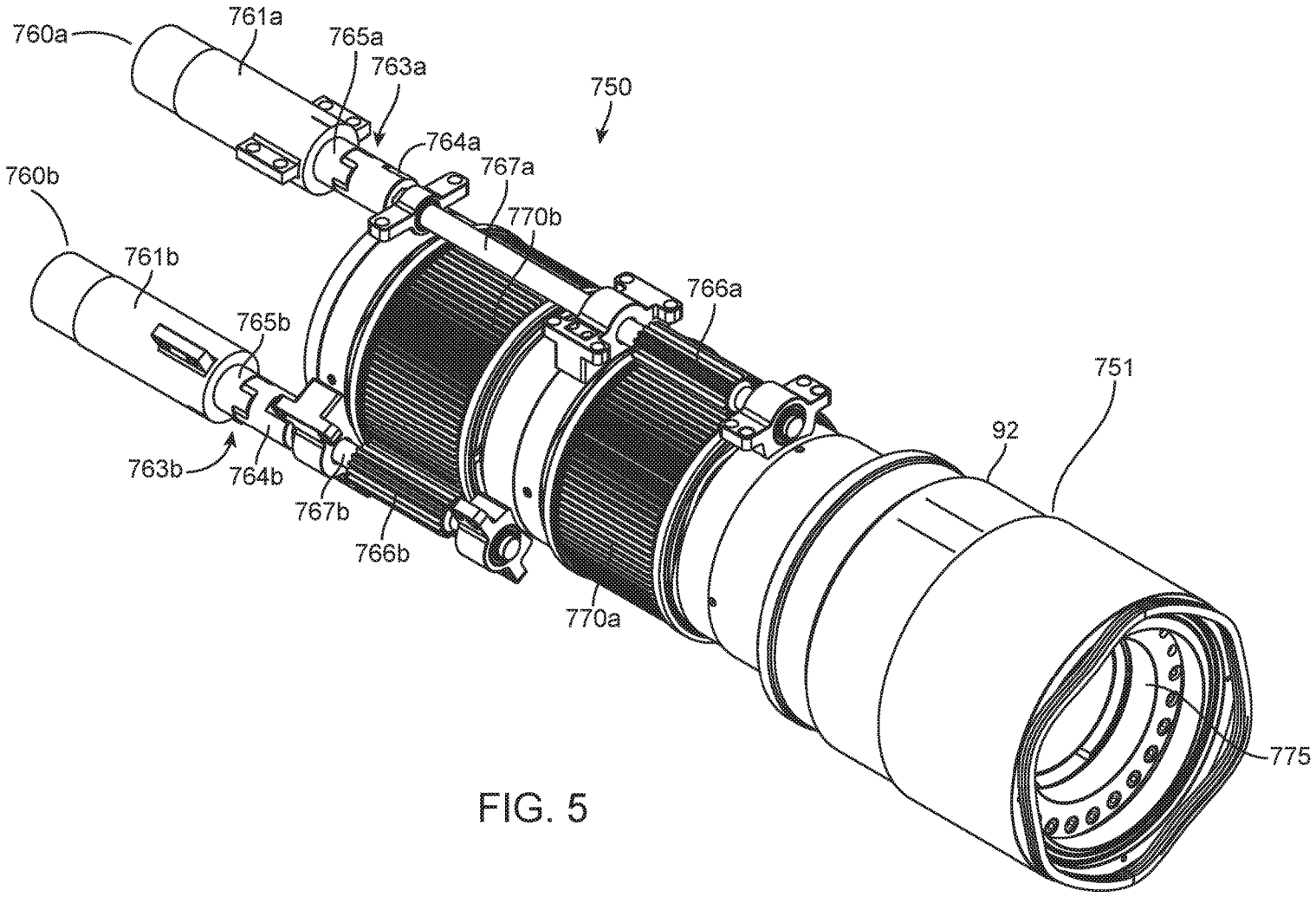
FIG. 5 is a perspective view of one embodiment of an internal portion of a drilling shaft deflection device having a pair of drive motors.

A mechanical actuator is disclosed that employs at least one motor for rotating the eccentric rings of the drilling shaft deflection assembly (92). Referring to FIG. 5, a drilling shaft deflection device (750) is shown with the housing removed, exposing the internal portion of the deflection device (750). Covered hatches (710*a*) and (710*b*) (shown in FIG. 2*a*) permit access to at least a portion of the deflection device (750) in an exteriorly exposable recess of the housing (46). The hatches (710*a*, 710*b*) can be secured to the housing (46) with threaded bolts or similar releasable securement mechanisms that facilitate the hatches' (710*a*, 710*b*) removal. A seal can also be provided between the hatches (710*a*, 710*b*) and the housing (46) which maintains a fluid tight, closed compartment within the housing (46).

Received beneath the hatches (710*a*, 710*b*) are two brushless DC (BLDC) drive motors; an outer eccentric ring drive motor (760*a*) and an inner eccentric ring drive motor (760*b*). Any type of motor may be used capable of providing rotational bias or power to the eccentric rings, including but not limited to hydraulic motors and electric motors. Suitable electric motors include AC motors, brushed DC motors, piezo-electric motors, and electronically commutated motors (ECM). The term ECM can include all variants of the general class of electronically commutated motors, which may be described using various terminology such as a BLDC motor, a permanent magnet synchronous motor (PMSM), an electrically commutated motor (ECM/EC), an interior permanent magnet (IPM) motor, a stepper motor, an AC induction motor, and other similar electric motors which are powered by the application of a varying power signal, including motors controlled by a motor controller that induces movement between the rotor and the stator of the motor.

In some examples the ECM can have built-in features which are inherent or included in the device. For example, the ECM can optionally have a braking mechanism, such as a detent brake, to prevent movement of the output shaft of the motor when the ECM is not being purposefully rotated. An additional built-in feature can include a feedback mechanism such as an included resolver or associated Hall effect sensors that track the position of the rotor relative to the stator in order to facilitate operation of the ECM by the motor controller.

Referring again to FIG. 5, the eccentric ring drive motors (760*a*, 760*b*) can be substantially cylindrical and small relative the size and diameter of the housing (46). The eccentric ring drive motors (760*a*, 760*b*) can be housed in a motor housing (761*a*, 761*b*) which provides a surface which substantially contains the contents of the drive motor components. The drive motor housing (761*a*, 761*b*), is radially offset, aside the longitudinal centerline of the housings (46). Further, the motor housings (761*a*, 761*b*) of drive motors (760*a*, 760*b*) can be anchored to the housing (46) located proximate thereto. The motor housings (761*a*, 761*b*) of the drive motors (760*a*, 760*b*) can be circumferentially spaced apart one from another about the housing (46). In such case, the motor housings (761*a*, 761*b*) of the drive motors (760*a*, 760*b*) can be circumferentially spaced apart, one from another, by any degree, including about 45 degrees, or about 60 degrees, or about 70 degrees, or about 90 degrees, or about 120 degrees, or about 180 degrees, and in some examples less than about 90 degrees, or less than about 180 degrees around the housing (46). In some examples, the drive motors (760*a*, 760*b*) are spaced so that they are easily accessible when hatches (710*a*, 710*b*), shown in FIG. 2*a*, are removed.

The drive motors (760*a*, 760*b*) are connected indirectly to the mechanical actuator (384) by fixed-ratio transmissions, or transmission components. These are fixed in their gear ratios such that upon rotation of a rotor within motors (760*a*, 760*b*) the fixed-ratio transmissions transmit the rotor's rotation to the mechanical actuator at a particular ratio. The transmissions include for example, spider couplings, shafts, pinions, spur gears further outlined and defined hereinbelow. In particular, the drive motors (760*a*, 760*b*) are each coupled to a pinion (766*a*, 766*b*) via upper spider coupling (763*a*) and lower spider coupling (763*b*). The spider couplings (763*a*, 763*b*) are each comprised of opposing interlocking teeth (762*a*, 762*b*) which communicate rotation from the drive motors (760*a*, 760*b*) to a set of pinions (766*a*, 766*b*). The upper coupling portion (765*a*, 765*b*) of each spider coupling (763*a*, 763*b*) includes a series of teeth and channels that engage a similar (mirror image) series of teeth and channels on the lower coupling portion (764*a*, 764*b*) of each spider coupling (763*a*, 763*b*).

There can be drive shafts (767*a*, 767*b*) which extend from the lower coupling portion (764*a*, 764*b*) to an outer eccentric ring pinion (766*a*) and inner eccentric ring pinion (766*b*). The respective pinions (766*a*, 766*b*) are each splined, having gear teeth that engage with an outer eccentric ring spur gear (770*a*) and inner eccentric ring spur gear (770*b*). The spur gears (770*a*, 770*b*) are each splined, having gear teeth that surround the entire peripheral edge of the respective gear and receive the teeth from pinions (766*a*, 766*b*). The spur gears (770*a*, 770*b*) can have substantially the same diameter, with a circumference less than that of the housing (46), and in some embodiments the same or greater than the outer eccentric ring (156).

The pinions (766*a*, 766*b*) are positioned adjacent the spur gears (770*a*, 770*b*), at their periphery, so that pinion teeth intermesh with spur gear teeth as shown in FIG. 5. The motors (760*a*, 760*b*) provide rotational driving force that is communicated through the spider coupling (763*a*, 763*b*) and drive shafts (767*a*, 767*b*) causing rotation of the pinions (766*a*, 766*b*). The rotating pinions (766*a*, 766*b*) engage and rotate the spur gears (770*a*, 770*b*). The spur gears (770*a*, 770*b*) can be connected directly or indirectly to the outer and inner eccentric rings (156, 158) contained within the body of the deflection device (750). For example, spur gears (770*a*, 770*b*) can be bolted to inner and outer eccentric rings (156, 158). In the illustrated example, the outer eccentric ring spur gear (770*a*) is coupled to the outer eccentric ring (156) via a linkage, which may take the form or an interconnected cylindrical sleeve. The inner eccentric spur gear (770*b*), however, is coupled to the inner eccentric ring (158) via an Oldham coupling. The Oldham coupling permits off-center rotation and the necessary orbital motion of the inner eccentric ring (158) relative the housing (46).

The inner eccentric ring spur gear (770*b*) permits deflection or floating of the drilling shaft (24) held in the interior aperture of the inner eccentric ring (156). As the drilling shaft (24) orbits about within the housing (46) as the orientations of the eccentric rings change, the powering transmission, at least to the inner eccentric ring (156), must shift in order to maintain connection to the ring (156), and this is accomplished by use of the Oldham coupling.

In the illustrated embodiment of FIG. 5, the drive motors (760*a*, 760*b*) are positioned at the top or proximal end (left side of the FIG. 5) of the drilling shaft deflection device (750). As shown, the outer eccentric ring pinion (766*a*) is positioned further down, toward the distal end of the drilling shaft deflection device (750). In other embodiments, the drive motors (760*a*, 760*b*) can be lengthwise offset, one from the other, relative the housing (46).

The outer eccentric ring spur gear (770*a*) and inner eccentric ring spur gear (770*b*) are positioned adjacent one another, but with the outer eccentric ring spur gear (770*a*) positioned further along the body in the distal direction.

With respect to deflection, the motors can rotate the eccentric rings to bend the drilling shaft (24) to any desired deflection ranging from no deflection up to the maximum amount mechanically permitted. As discussed previously with respect to FIG. 3, in a "Deflection OFF" setting, the center C of inner eccentric ring (158) is positioned on the rotational axis A of outer ring (156) thereby providing no deflection (i.e., "e" minus "e"). In a "Deflection ON" setting, the eccentric rings (156, 158) are oriented so that the axial centers add to each other giving a non-zero result (i.e., "e" plus "e" is not equal to zero).

In order to deflect drilling shaft (24), outer eccentric ring drive motor (760*a*) can hold outer eccentric ring (156) from rotating while at the same time inner eccentric ring drive motor (760*b*) can apply rotating force to rotate inner eccentric ring (158) in either direction (clockwise or counterclockwise; i.e., bi-directional). Alternatively, inner eccentric ring drive motor (760*b*) can hold inner eccentric ring (158) from rotating while at the same time outer eccentric ring drive motor (760*a*) can apply rotating force to rotate outer eccentric ring (156) in either direction. Additionally, both motors (760*a*, 760*b*) can be simultaneously operated which correspondingly rotates eccentric rings (156, 158) to achieve a desired deflection.

In practice, a control signal is sent to one or both motors (760*a*, 760*b*) which then actuates and applies a rotating force through one or both spider couplings (763*a*, 763*b*) to drive the shafts (765*a*, 765*b*) that rotate their respective pinions (766*a*, 766*b*). The pinions (766*a*, 766*b*) engage and rotate their respective spur gears (770*a*, 770*b*), which communicate rotation to the respective eccentric rings (156, 158). In this way, the eccentric rings can be singly, or simultaneously rotated from a position in which the axial centers are aligned (i.e., "e" minus "e" equals zero) to any other desired position within a circle having a radius of "2e" around the centerline A of the housing (46). In this way the drilling shaft (24) is deflected at a desired angle. That is, the amount of deflection is affected based on how far the drilling shaft (24) is radially displaced (pulled) away from the centerline of the housing (46). The degree of radial displacement can be affected by rotation of one or both of the eccentric rings (156, 158), in either direction.

In practice, the drilling shaft (24) is effectively supported at three locations in the housing (46): at each of the two ends of the housing (46) by radial or fulcrum bearings and at the middle of the housing (46) by the eccentric rings (156, 158). The fulcrum bearings keep the drilling shaft (24) centered on the centerline of the housing (46) at their locations, but permit the shaft to pivot at the bearing, resulting in the shaft (24) projecting from the bottom end of the housing (46) at a particular angle when the middle of the shaft is radially pulled to the side, out of alignment with the centerline of the housing (46). The degree to which the drilling shaft (24) is pulled out of alignment from the centerline of the housing (46) dictates the severity of the angle, relative to the centerline of the housing (46), by which the drilling shaft (24) projects out of the bottom end of the housing (46).

Once the desired deflection is obtained, indexing can be carried out to set the direction of the drilling shaft (24). Most simply, both the outer and inner eccentric rings (156, 158) can be rotated together, as a unit, in order to "point" the projecting drilling shaft (24) in a particular direction, while maintaining the angle of deflection. This can be accomplished by fixing the inner eccentric ring (158) relative to the outer eccentric ring (156), and then rotating the outer eccentric ring (156). This causes the now-deflected drilling shaft (24) at the inner eccentric ring (158) to "orbit" on a circle having a radius equal to the distance of deflection of the drilling shaft (24) off of the centerline of the housing (46). In practice, indexing is performed to set a desired azimuthal direction of the drill bit (22) at the bottom end of the drilling shaft (24) which also sets the orientation of the toolface of the bit (22).

In another aspect, though anchored to the wellbore, the rotary steerable drilling device (2) will still experience some slippage relative to the ground, causing the housing (46) to "roll" within the wellbore from its original and known orientation. Accordingly, to counteract such housing roll and maintain the intended azimuthal drilling direction, one or both of the eccentric rings can be rotated together to maintain a desired amount of deflection and the desired azimuthal drilling direction. With dual ECM motors, the deflection and azimuthal direction can be obtained simultaneously by independent rotation of the outer eccentric ring (156) and inner eccentric ring (158).

Anti-Rotation Device

As explained above, during drilling, the rotary steerable drilling device (20) is anchored against rotation in the wellbore which would otherwise be imparted by the rotating drilling shaft (24). To affect such anchoring, one or more anti-rotation devices (252) (FIGS. 2*a*, 2*b*, 6-9) are associated with the rotary steerable drilling device (20) for resisting rotation within the wellbore. Any type of anti-rotation device (252) or any mechanism, structure, device or method capable of restraining or inhibiting the tendency of the housing (46) to rotate upon rotary drilling may be used.

Figure 6:
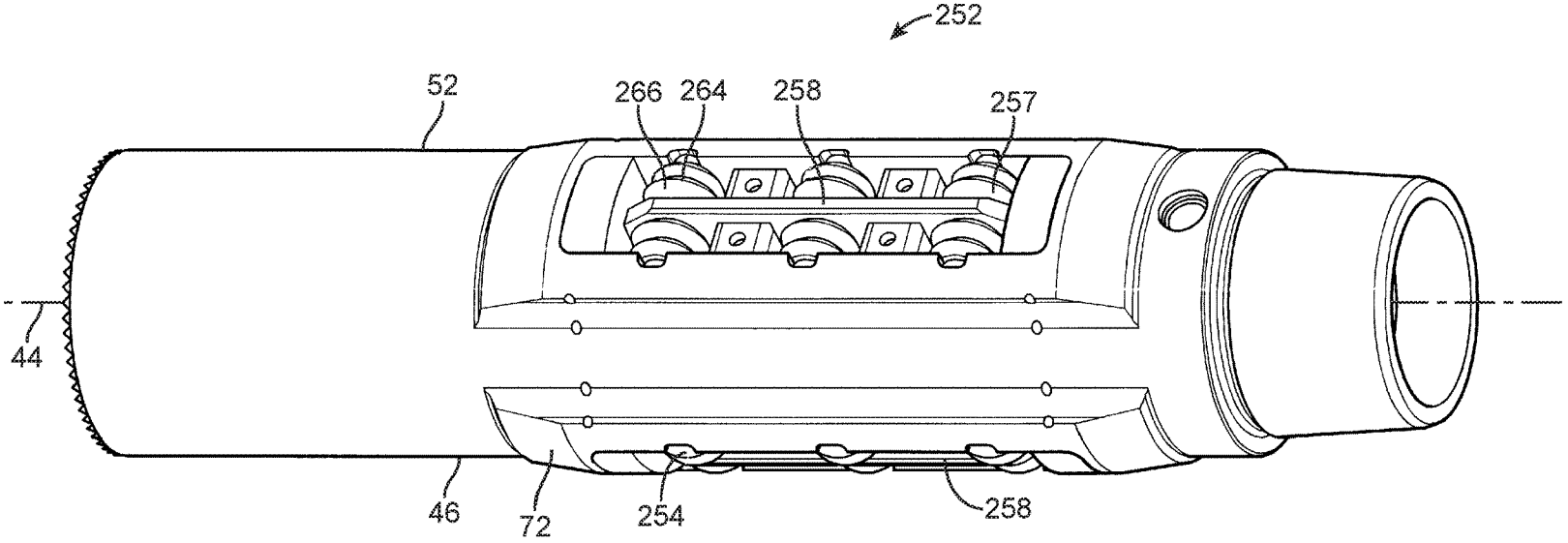
FIG. 6 is a perspective side view of an anti-rotation device.
Figure 7:
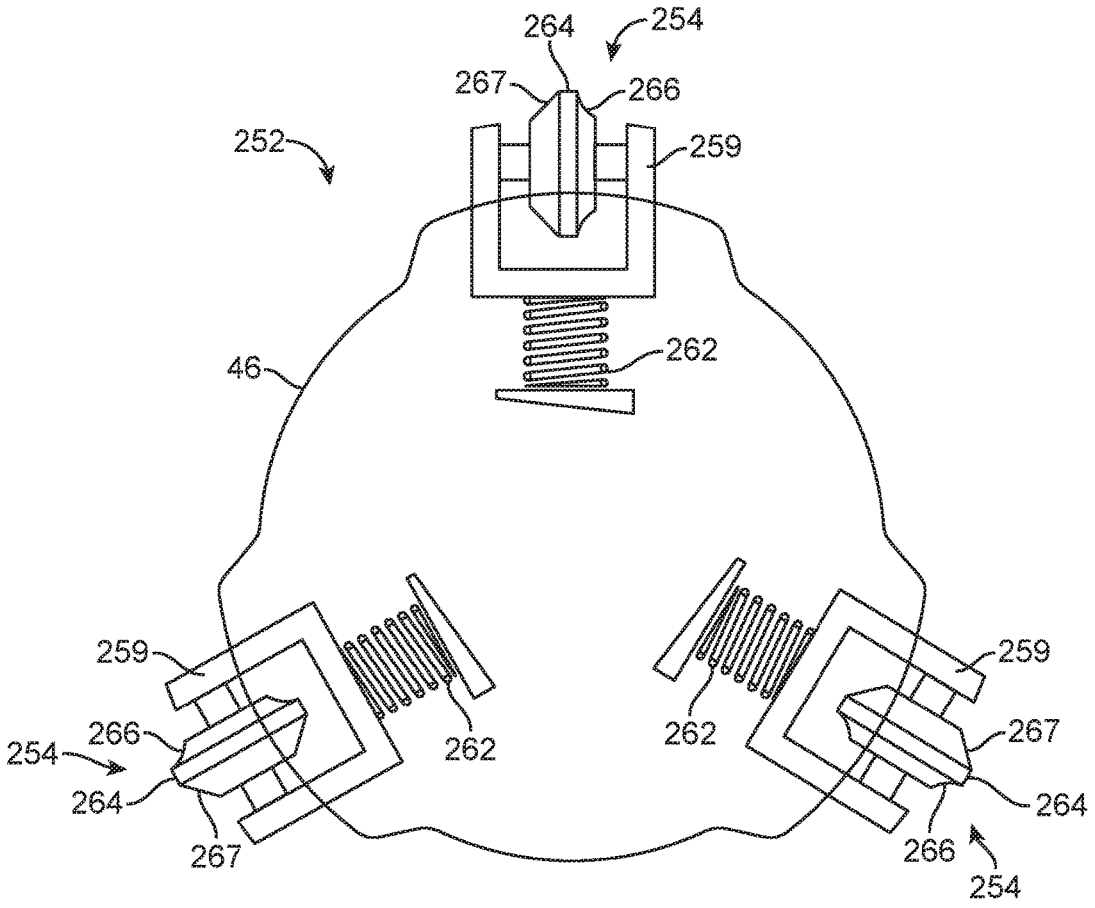
FIG. 7 is a cross-sectional view of a spring-biased, anti-rotation device in a first settable operational configuration.

Referring now to FIGS. 6 and 7, the anti-rotation device (252) may be associated with any portion of the housing (46) including proximal, central and distal housing sections. In other words, the anti-rotation device (252) may be located at any location or position along the length of the housing (46) between its proximal and distal ends. In the illustrated embodiment, the device (252) is associated with the proximal housing section, upward, toward the ground's surface. Finally, the device (252) may be associated with the housing (46) in any manner permitting the functioning of the device (252) to inhibit or restrain rotation of the housing (46). However, preferably, the anti-rotation device (252) is positioned at an exterior surface of the housing (46), preferably the exterior (52) of the proximal housing section. Specifically, the anti-rotation device (252) is positioned on, connected to, otherwise affixed or recessed into or mounted on the exterior or periphery (52) of the portion of the housing (46) where the anti-rotation device (252) is located.

In some examples, the anti-rotation device (252) has at least one, or a plurality of radially deployable drag members (254), extendable with respect to the longitudinal centerline (44) of the housing. As shown in FIG. 6, the drag members (254) can be wheels or rollers and resemble round "pizza cutters" that extend at least partially outside the rotary steerable drilling device (20) and project into the formation surrounding the borehole when deployed. The drag members (254) are aligned for rotation down the wellbore, allowing the rotary steerable drilling device (20) to progress downhole during drilling. Each drag member (254) is oriented such that it is capable of rotating about its axis of rotation in response to a force exerted tangentially on the drag member (254) substantially in a direction parallel to the longitudinal axis (44) of the housing (46). For instance, as a longitudinal force is exerted through the drill string (25) to the drilling shaft (24) in order to progress drilling, the drag member (254) rolls about its axis to facilitate the drilling device's (20) movement through the wellbore in either a downhole or uphole direction.

The drag members (254) contact the wall of the wellbore to slow or inhibit turning of the housing (46) with the drilling shaft (24) while drilling. The shaft (24) contained within the housing (46) rotates in the clockwise direction, thus imposing a tendency in the housing (46) to also rotate. Accordingly, drag members (254) can have any shape or configuration permitting them to roll or move longitudinally through the wellbore, while also restraining the housing (46) against rotation within the wellbore. Therefore, each roller (254) has a peripheral surface (264) about its circumference permitting it to roll or move longitudinally within the wellbore and resist rotation. The shape of the drag members (254) can be viewed better in FIG. 7. The periphery of each of the plurality of drag members (254) can be shaped to penetrate borehole-surrounding formation material. In particular, the peripheral surface (264) is differently shaped on each side presenting a resistive side-face (266) and a slip side-face (267). In particular, resistive side-face (310) is radiused with sufficient concavity that during clockwise torque or rotation of the housing (46), the drag member (254) penetrates into the formation and resists housing (46) rotation. Slip side-face (267) presents a beveled surface or ramp that permits rotation of the housing (46) in the counter-clockwise direction, albeit, with a certain amount of drag associated with the slippage. Therefore, rather than cutting into the formation during a counter-clockwise rotation of housing (46), slip side-face (267) can scrape or slip along the wellbore surface, permitting rotation.

Moreover, as shown in FIG. 7, three sets of drag members (254) can be spaced peripherally (circumferentially) at equidistant points about the housing (46), for example each at 120 degrees from each other, as shown. There can be a greater number of drag member (254) sets, for example, 4, 5, 6, 7, 8 or more, but still, equally spaced about the exterior (52) of the housing (46). Returning now to FIG. 6, recessed within the housing (46) are three sets (257) of drag members (254); however, due to the perspective view of FIG. 6, only two sets can be seen, spaced axially or longitudinally along the housing (46). Each is deployable in different configurations, and may take on a plurality of different deployed configurations. Alternatively, the drag members (254) can be similarly deployed, one to the others, in a uniform configuration.

Moreover, each set contains four coaxial drag members (254) that are shown oriented side-by-side, in the circumferential direction of the anti-rotation device (252) in FIG. 6. In other embodiments, such as in FIG. 7, the sets can comprise individual drag members (254) that are singly arranged about the anti-rotation device (252).

As depicted in FIG. 6, the drag members (254) can be attached or mounted to frames (258), that act as carriage assemblies that can be mounted, connected or affixed at the outer surface of the housing (46) in any suitable manner. In some examples, the plurality of frames (258) are circumferentially and equidistantly spaced about the housing (46).

Figure 8:
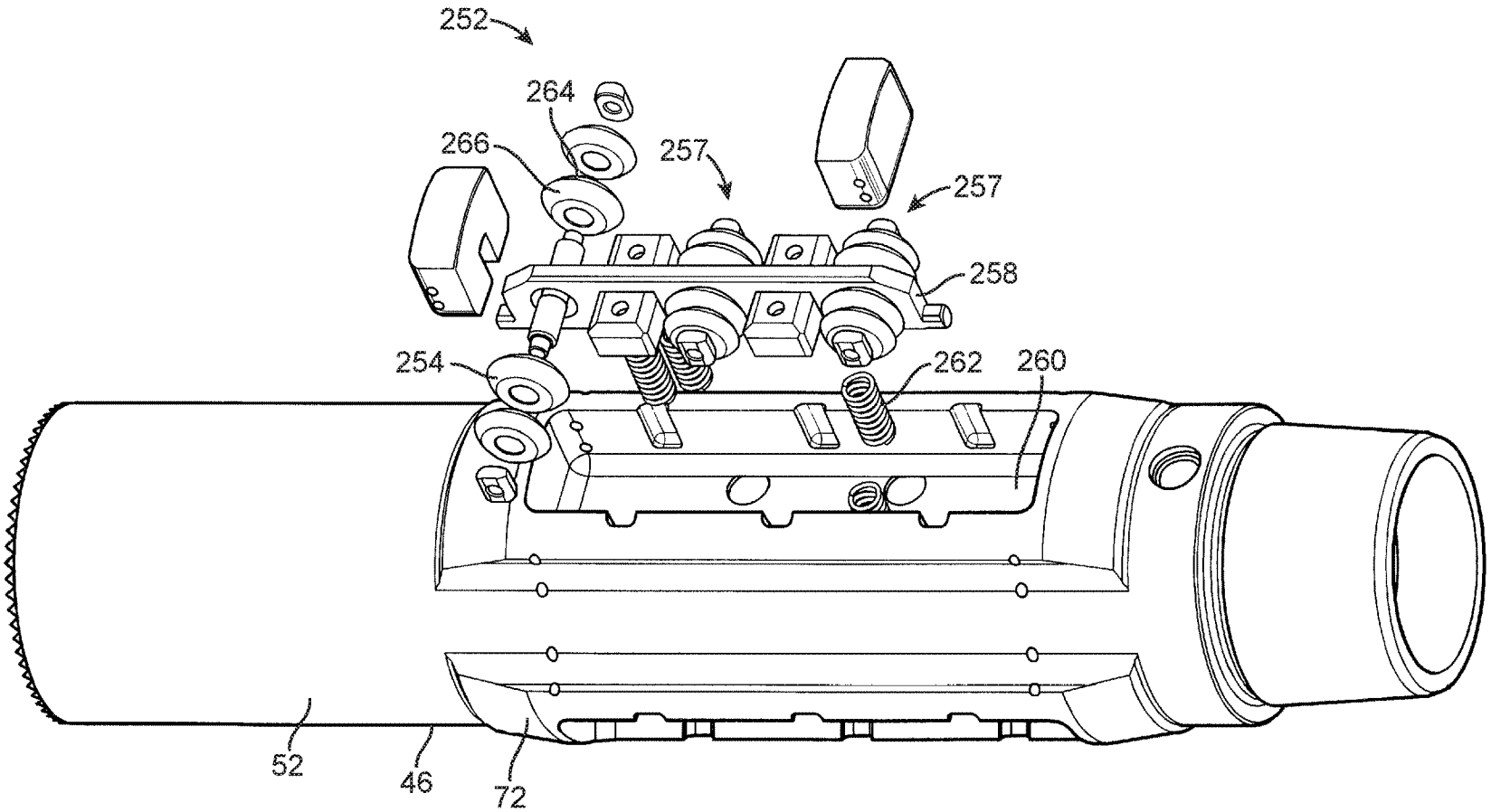
FIG. 8 is an exploded perspective side view of the anti-rotation device of FIG. 6.

An exploded view of the anti-rotation device (252) is shown in FIG. 8. As illustrated, the exterior (52) of the proximal housing section can have defined therein a separate cavity (260) for fixedly or movably receiving each of the frames (258) therein. The carriage assembly (258) may be stationarily or movably received in the cavity (260) and mounted, connected or otherwise affixed therewith in any manner and by any method, mechanism, structure or device able to withdraw the carriage assembly (258) into the cavity (260), as well as deploy the carriage assembly (258) out of the cavity (260) during drilling operations.

Further, in order to facilitate the rolling movement of the drag members (254) longitudinally along the wellbore and to enhance the anti-rotation qualities of the drag members (254), each is capable of movement from a retracted position to an extended position(s) in which the drag member (254) extends radially from the housing (46). Accordingly, a biasing mechanism or device can be provided made up of, for example, a spring (262) that acts directly or indirectly between the housing (46) and the carriage assembly (258) or the rollers (254).

Figure 9:
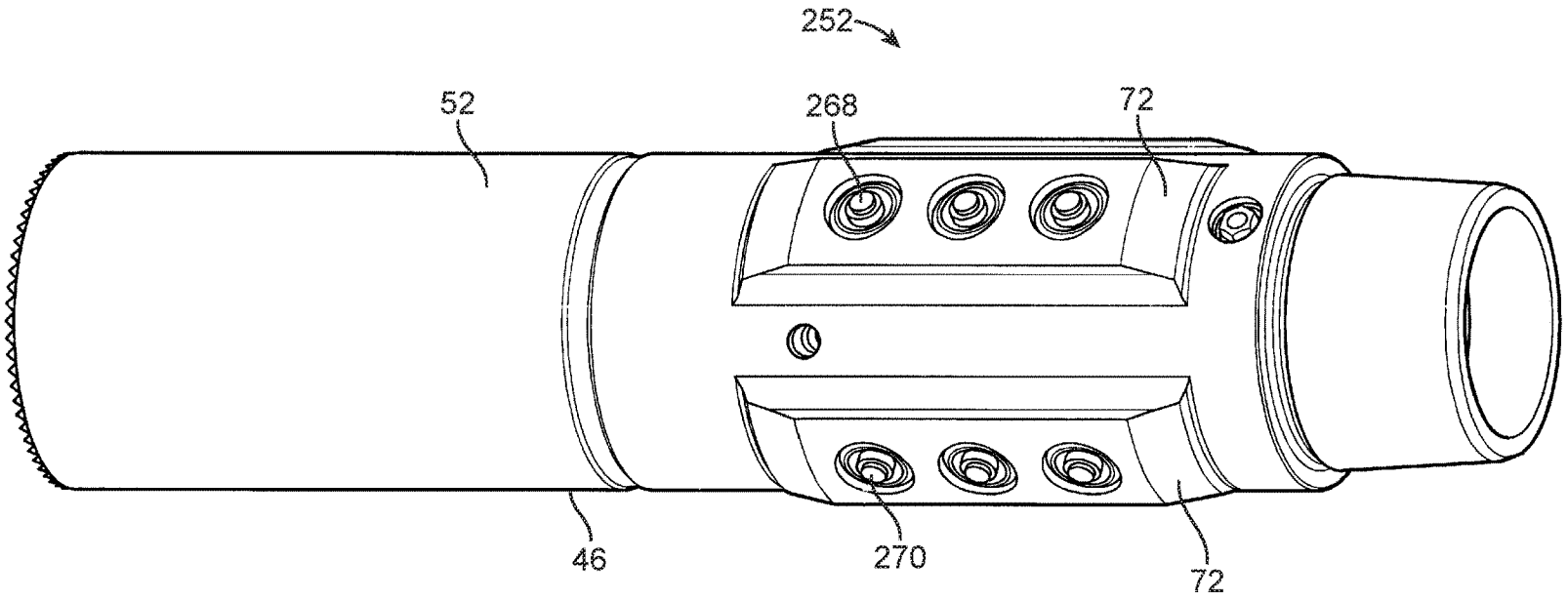
FIG. 9 is a perspective side view of an alternate anti-rotation device.

In an alternate embodiment, shown in FIG. 9, the anti-rotation device (252) comprises at least one piston (268) on, or associated with the housing (46), and specifically the exterior (52) of the housing (46). In this instance, the piston (268) contacts the wall of the wellbore to impede rotation of the housing (46), with the drilling shaft (24), while drilling.

More particularly, an outer surface or tip (270) of the piston (268) extends from the housing (46) for engagement with the wall of the wellbore.

Directional Steering with the Anti-Rotation Device

Figure 12:
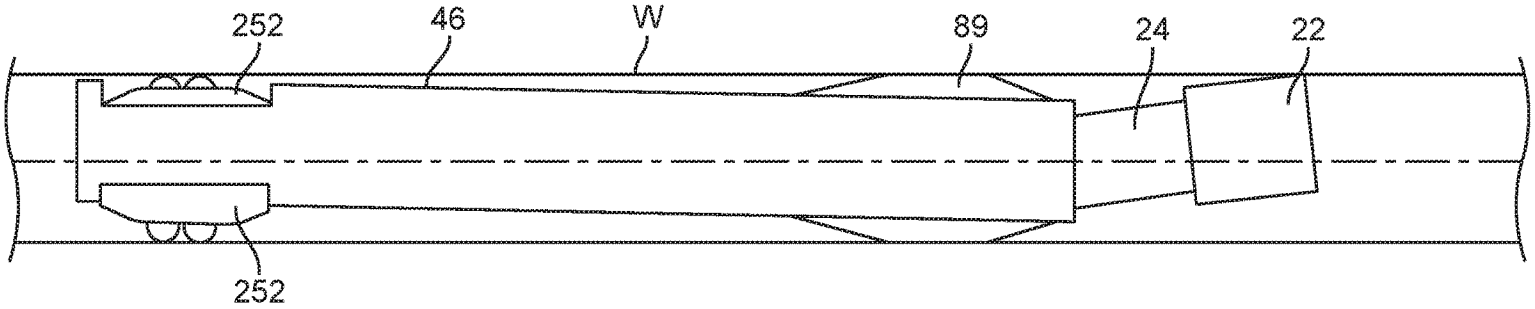
FIG. 12 depicts the deflected drill bit of FIG. 11, but an included anti-rotation device moves the housing away from the wellbore, slightly.

During drilling operations, there can be several lateral loads exerted on the rotary steerable tool by the borehole (generally, represented by points of contact between the tool and borehole in FIG. 12) that if not properly proportioned can reduce build angle capability and thus the ability to steer the drill bit (22). For example, a first distal lateral load will be exerted by the formation on the side of the drill bit (22) as a reaction force on the toolface in opposition to the drilling activity. An intermediately located, second lateral load is exerted at the near bit stabilizer (89), and acts as a fulcrum or pivot point. A proximal third lateral load may be exerted by the borehole on the anti-rotation device (252) as a result of engagement between the anti-rotation device and the wellbore. The third lateral load is typically acting in the same direction as the first lateral load; that is, same as the direction of the force acting on the toolface of the drill bit. Further, the third lateral load is being exerted from the same side of the wellbore from which the toolface force is acting.

A drilled borehole typically has a larger interior diameter than the exterior diameters of the rotary steerable device. As a result, the lateral load acting on the toolface of the drill bit can cause the opposite end of the rotary steerable drilling device to tilt laterally (rotate axially) toward the wellbore wall (see FIG. 11).

In the three-point loading system described above, the near-bit stabilizer (89) provides a fulcrum or pivot point for the rotary steerable tool, around which both the drill bit (22) and the anti-rotation device (252) will tend to pivot axially (right and left sides go up and down about the pivot point of the near-bit stabilizer (89). The up-down shift of the proximal end (left end in FIG. 11) of the rotary steerable device about the fulcrum has the undesirable effect of diminishing the load at the drill bit which reduces the amount of deviation or build angle imposable at the toolface when drilling.

To avoid this result, a counteracting force can be exerted by the anti-rotation device (252) to push the tilted-up, proximal end (left end in FIG. 12) of the rotary steerable device back in the opposite direction (down in FIG. 12). With sufficient force exerted by the anti-rotation device (252), the proximal (left) end of the rotary steerable device can be moved away from the wellbore, straightening the housing (46) within the wellbore. By applying pressure against the wellbore using the anti-rotation device (252), the housing (46) is pushed away from the wellbore thereby forcing the drill bit (22) on the opposite end into the formation and thereby exerting a greater toolface biasing load. This has the effect of increasing force at the drill bit (22), enhancing the distal lateral load that can be applied at the bit and potentially increasing the build angle of the rotary steerable tool.

Figure 10:
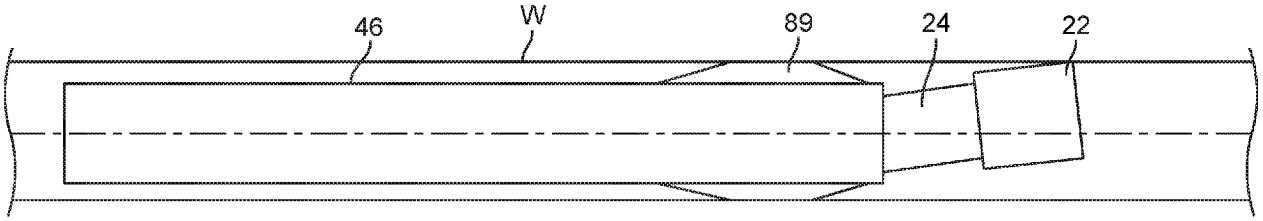
FIG. 10 is a schematic depicting a deflected drill bit of a rotary steerable drilling device, whose housing is centered in a wellbore.
Figure 11:
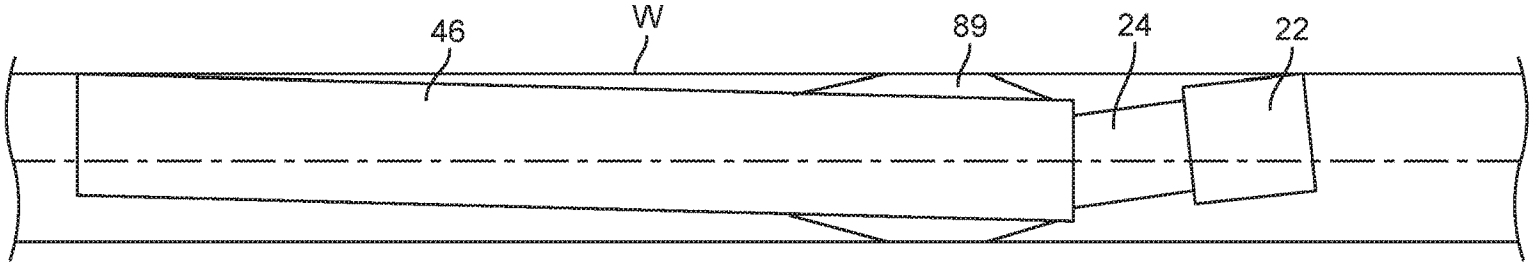
FIG. 11 depicts a deflected drill bit with the housing of the rotary steerable drilling device laterally shifted, or pivoted up within the wellbore.

The fulcrumed behavior described above, and the corrective action that can be taken using the anti-rotation device (252) is best appreciated if FIGS. 10-13 are viewed as a progression. A simple deflection of the shaft in a point—the bit system is represented in FIG. 10. As the drill bit (22) is deflected with respect to the housing (46), a side force is created on the toolface of the drill bit (22). As a result, the stabilizer (89) mounted near the drill bit (22) acts as a fulcrum and the rotary steerable drilling device (20) pivots in the wellbore W about the stabilizer (89) contact point, shifting toward the wellbore W as illustrated in FIG. 11.

Figure 13:
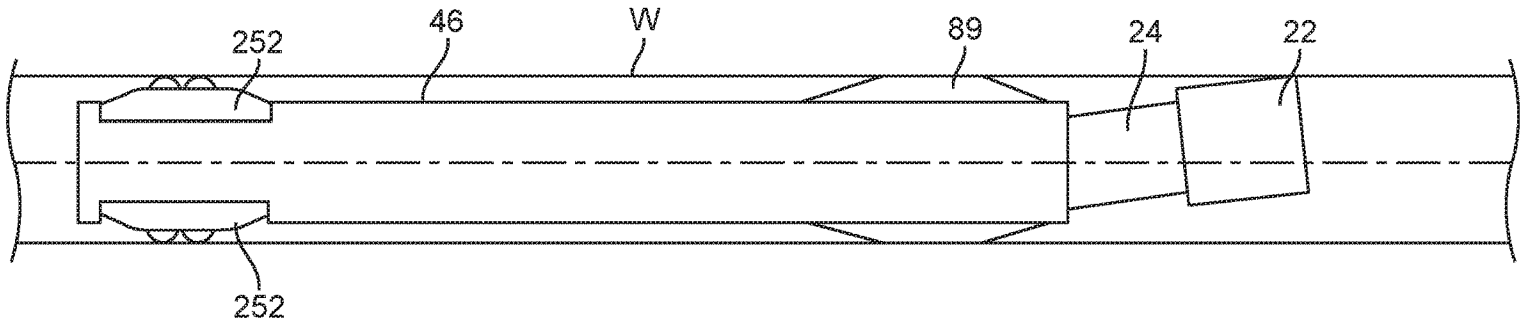
FIG. 13 depicts the deflected drill bit of FIG. 11, but the included anti-rotation device is expanded, moving the housing further away from the wellbore, and serving to counteract the formation force bearing on the drill bit, and therefore contributing to "steering" the bit.

In order to oppose the pivoting lateral shift of the housing (46), drag members (see FIGS. 12 and 13 for the pizza-cutter styled wheels) can be manipulated to provide a counteracting force sufficient to counteract the force experienced at the drill bit (22) from the wellbore W. Accordingly, the drag members can be deployed radially with respect to the longitudinal centerline of the housing (46) in different configurations, and extend to push the housing (46) away from the wellbore. In the example depicted by moving from the configuration of FIG. 12 to the configuration of FIG. 13, the drag members extend from a retracted configuration (FIG. 12) to a deployed configuration (FIG. 13), pressing against the wellbore W to push the housing (46) down, in the direction opposite the toolface direction of the rotary steerable drilling device. This effectively enhances the distal lateral load and potentially increases the build angle of the rotary steerable drilling device (20). In particular, FIG. 13 shows the drag members of the anti-rotation device (252) extended against the wellbore, pushing the housing (46) laterally down such that the longitudinal axis of the housing (46) is pushed from being oblique to the longitudinal axis of the wellbore W into alignment with the longitudinal axis of the wellbore W. In some cases, the longitudinal axis of the housing (46) can be pushed further beyond the longitudinal axis of the wellbore W to exert even greater force on the drill bit (22).

Delivering the force at the anti-rotation device (252) to counteract the wellbore force at the bit (22) can be accomplished in multiple ways. Using the simplified schematic in FIG. 14 of an anti-rotation device (252) as an example, the drag members (254) can be deployed to extend greater or lesser extents to counteract the formation force experienced at the toolface of the drill bit (22). In particular, different drag members (254) or sets of drag members (254) can have a minimum or standard force, and then be selectively deployed or activated to push the housing (46) away from the wellbore W when formation force is experienced at the drill bit (22).

Figure 14:
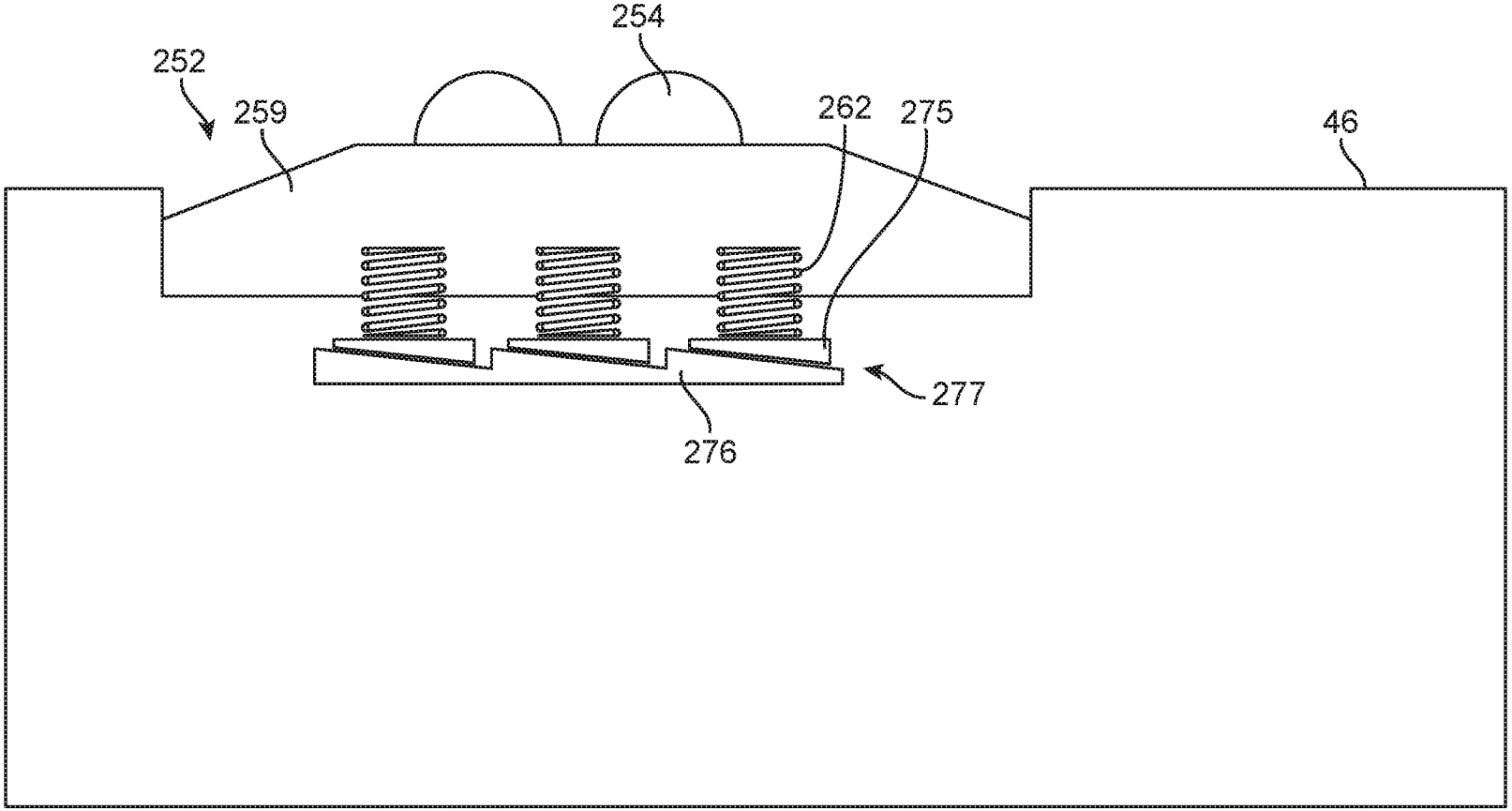
FIG. 14 illustrates an anti-rotation device with complementary, inclined, abutting surfaces (wedges) that together form a base for a spring-biased carriage on which the drag members are positioned, and movable between different deployment configurations.

In the example of FIG. 14, the anti-rotation device (252) is spring actuated, and includes a biasing mechanism (276) for extending the base of the springs (262) radially with respect to the longitudinal centerline of the housing (46), thereby increasing the pressure that the springs (262) can exert. As illustrated in FIG. 14, anti-rotation device (252) can include complementary ramp surfaces (277) for extending the drag members (254). For example, anti-rotation device (252) can include top ramp (275) and base ramp (276) that together constitute a base for the biasing springs (262). In order to reposition the springs (262) radially, the base ramp (276) moves distally (to the right in FIG. 14). As the peak (thick) portions of each ramp oppose one another, the top ramp (275) is moved upward (radially outward). As a result, the drag members (252) are extended outward from the housing (46). Alternatively, the complementary ramps (275, 276) reposition (raise) a restraining carriage assembly (259) relative to the housing (46). Accordingly, the drag members (252) are raised along with the restraining carriage assembly (259). In other examples, the top ramp (275) can be the one that moves, or both ramps (275, 276) can move relative to one another to extend the drag members (252).

Moving the drag members (254) further outside the anti-rotation device (252), and in turn moving the springs (262) closer to the wellbore wall (W) as depicted in FIG. 14, has the effect of increasing the springs' spring force if in the process, the drag members (254) are compressed against the wellbore. This is a consequence of the fact that a spring exerts greater force the more it is compressed. Accordingly, by moving the base of the springs (262) radially outward from the housing (46), toward the wellbore wall (W), the springs (262) compress against the wall, thereby delivering greater force. As outward movement of the drag member(s) (252) continues, the reaction force pushing back shifts the housing (46) away from the wellbore, in the direction opposite the toolface.

Figure 6A:
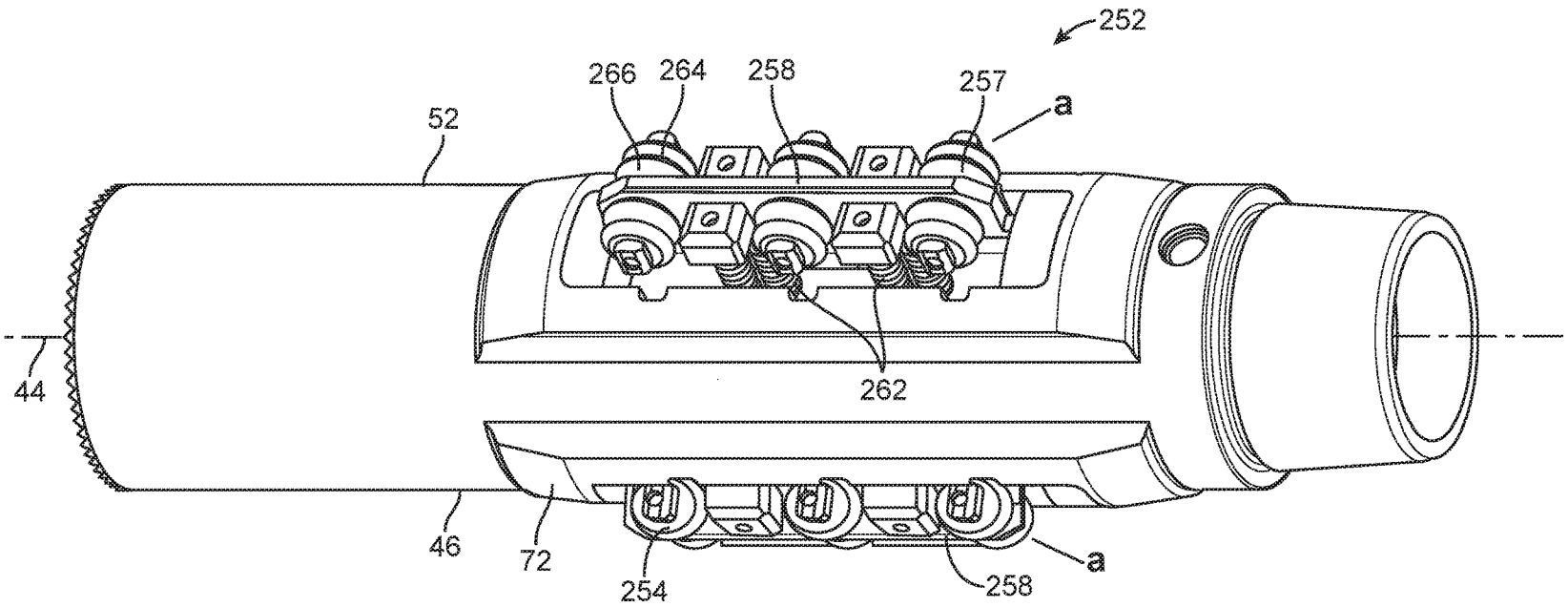
FIG. 6*a* is a perspective side view of an anti-rotation device with drag members each extended the same amount into a first settable operational configuration.
Figure 6B:
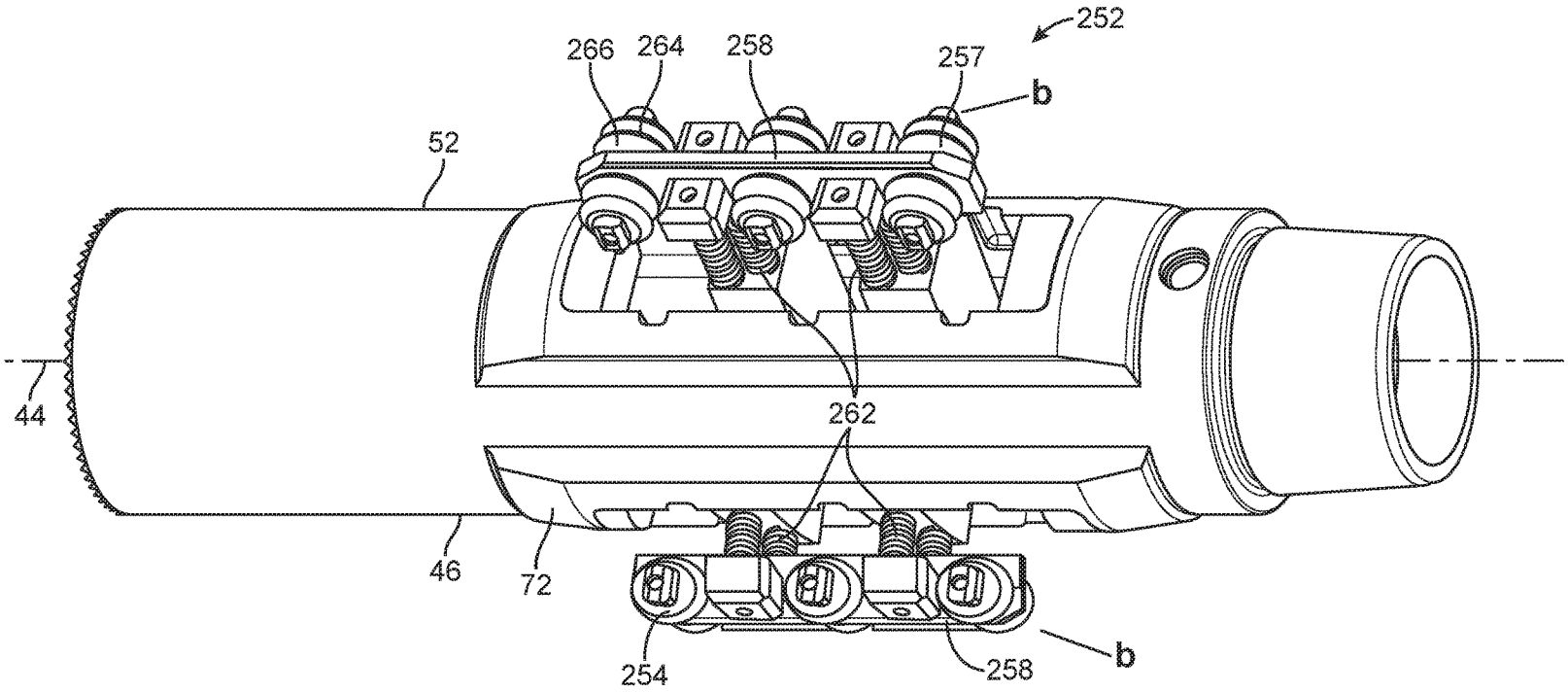
FIG. 6*b* is a perspective side view of an anti-rotation device with drag members each extended the same amount, but more than in FIG. 6*a*, into a second settable operational configuration.
Figure 6C:
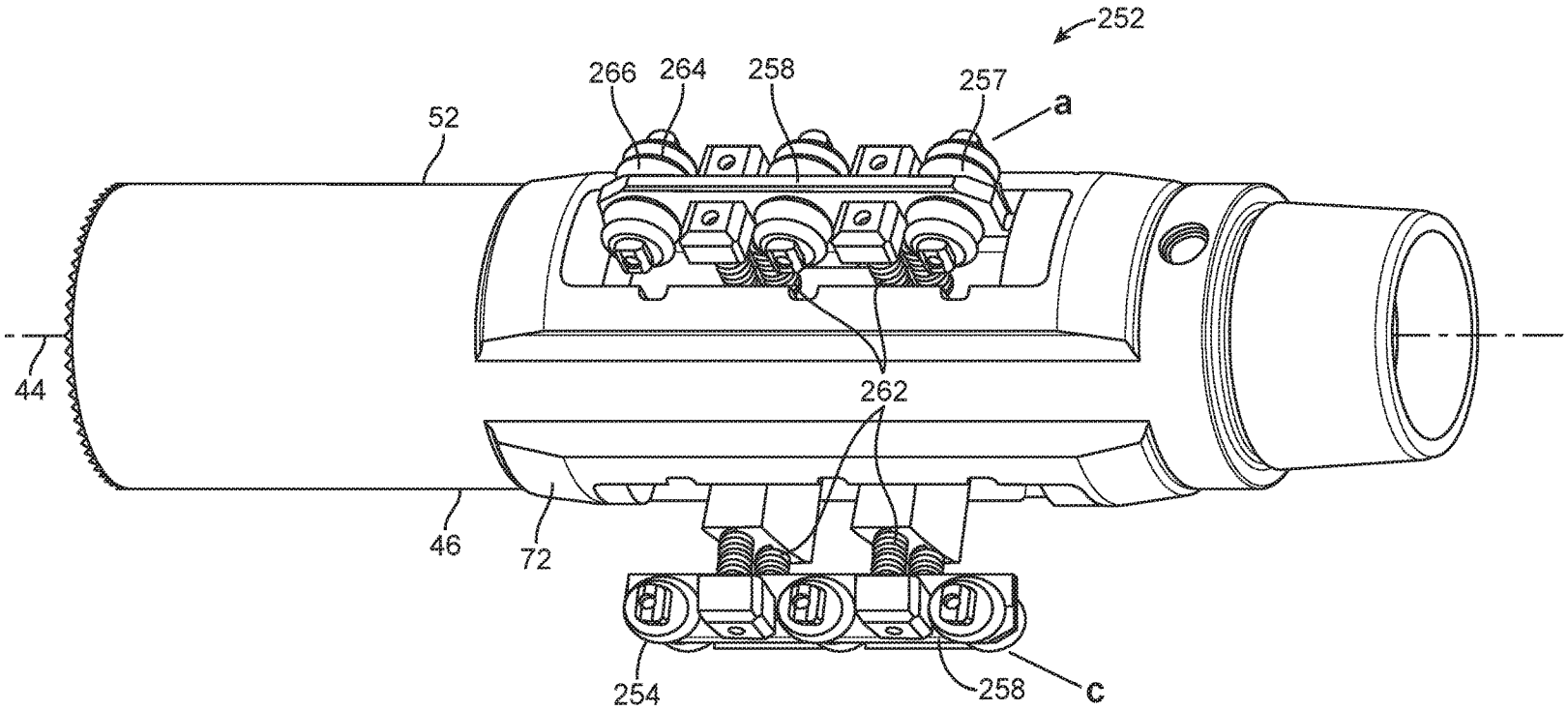
FIG. 6*c* is a perspective side view of an anti-rotation device with the drag members extended different amounts, establishing different deployed configurations.

This type of variable extension is exemplarily shown in FIG. 6*c*. For example, the top frame (258) is extended to a distance "a," whereas the lower (side) frame (258) is extended a distance "c." Therefore, the frames (257) are in differently deployed configurations and the anti-rotation device (252) is said to be in a differently deployed configuration. The side frame (258) is extended further out and therefore its springs (262) will compress against the wellbore with greater force. It is therefore this lower, more extended drag member that counteracts the formation force at the toolface of the drill bit (22).

Figure 7A:
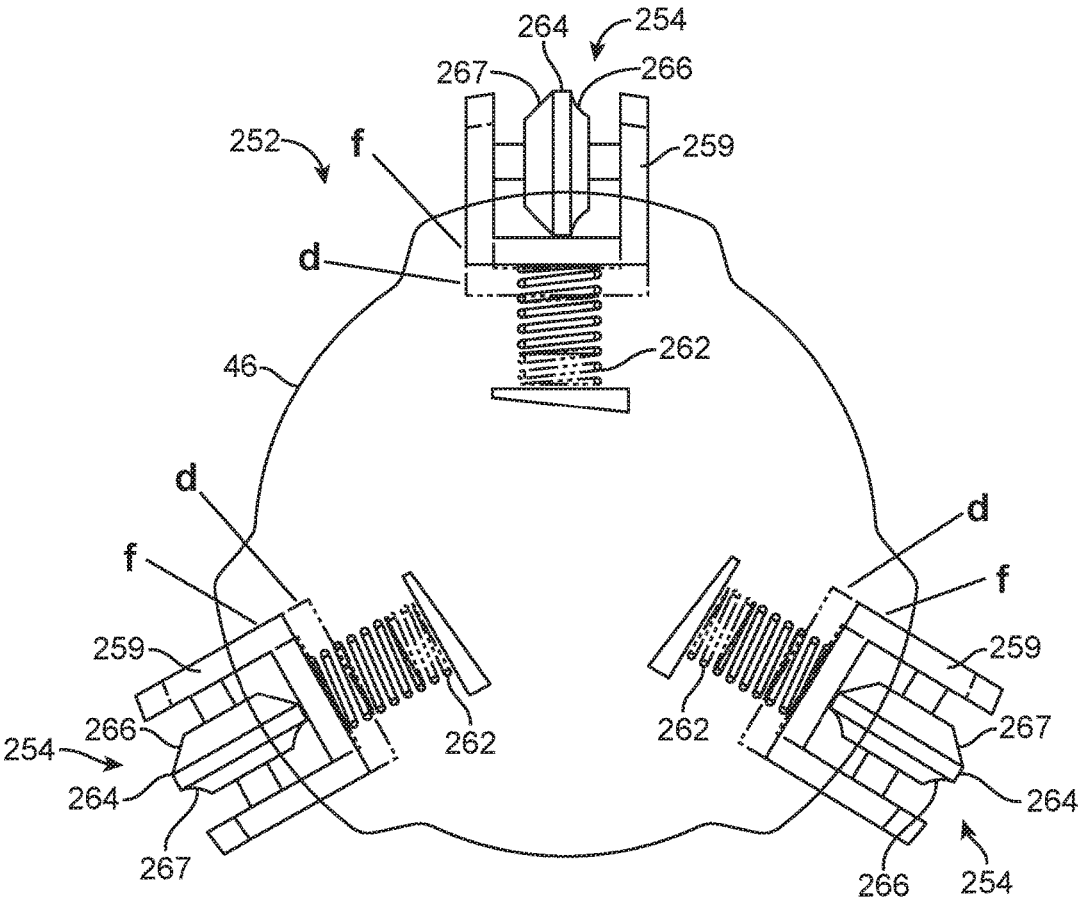
FIG. 7*a* is a cross-sectional view of the anti-rotation device with drag members further extended than in FIG. 7 to a different settable operational configuration.
Figure 7B:
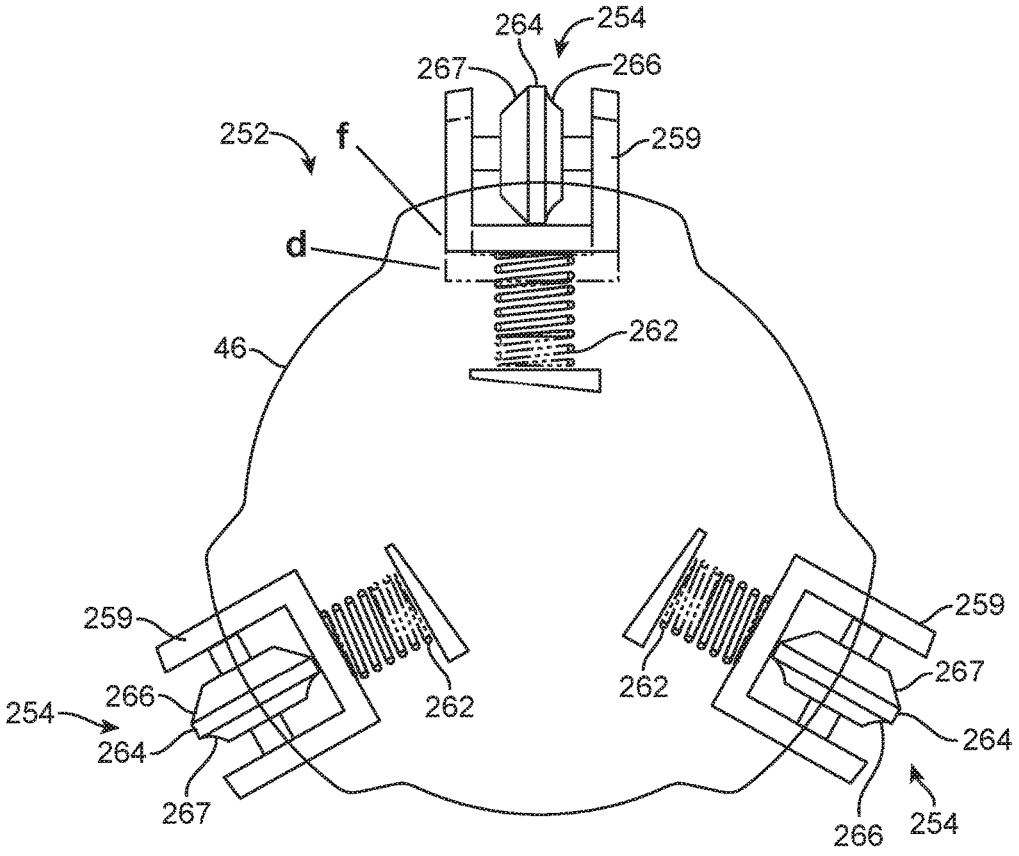
FIG. 7*b* is a cross-sectional view of the anti-rotation device with drag members extended different lengths into different deployed configurations.

Correspondingly, FIG. 7*b* also shows one of its frames (259) (the top one, as shown) extending from a first position "e" to a second position "f" thus extending closer to the wellbore wall than the other frames (259). This has the effect of applying a greater magnitude force against the wellbore, and acts to push the housing (46) laterally in the opposite direction. The second, deployed configuration aids in counteracting the reaction force applied at the toolface of the drill bit (22).

One or more force sensors can be employed to detect the toolface direction of the drill bit (22), as well as the magnitude of the formation force acting on or experienced by the toolface of the drill bit (22). Additionally, or alternatively, one or more force sensors can be employed to detect the force delivered or received by drag members (254) and springs (262). The detected information from these force sensors can be delivered to a controller which is communicatively coupled to deployment actuators. Accordingly, the sensor or sensors send output data representative of the detected toolface direction of the drill bit (22), as well as the detected magnitude of the formation force acting on the drill bit (22) to the controller. The controller which is communicatively coupled to the actuators for deploying the drag members (254) can then send an instruction to establish the different configurations of the drag members (254) to the degree necessary to counteract the force of the wellbore W acting on the toolface, and thus straighten the housing (46) in the wellbore W.

Figure 15:
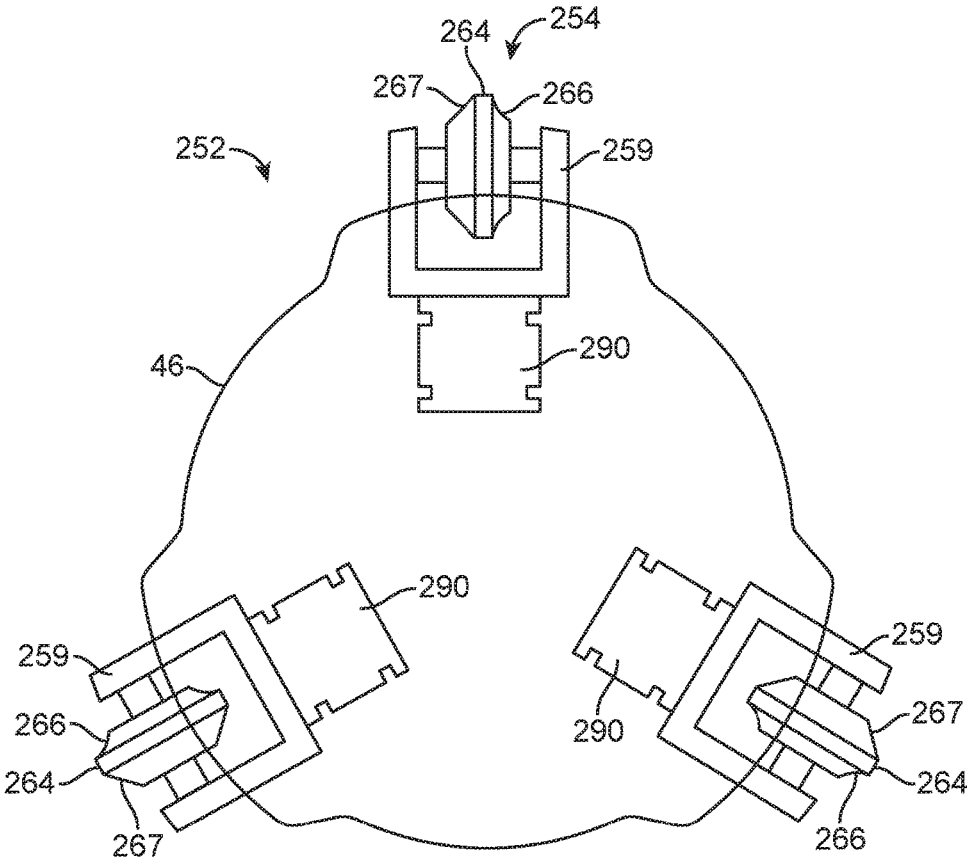
FIG. 15 is a cross-sectional view of a hydraulically-biased, anti-rotation device in a first settable operational configuration.

Extension of the drag members (254) can be powered with hydraulics. As illustrated in FIG. 15, hydraulic actuators or members (290) are provided that actuate to provide pressure and deploy to extend the drag members (254). The hydraulic actuators (290) can include a hydraulic pump, a cylinder and a piston that under pressure deploy the drag members (254) or the carriage assembly (259). Similarly to the actuation of the ramped surfaces (277) in FIG. 14, sensors can be employed to detect the toolface direction of the drill bit (22) as well as the magnitude of the formation force acting on or experienced by the toolface of the drill bit (22). The detected information from these sensors can be delivered to a controller which is communicatively coupled to the hydraulic actuators (290). The controller, which is communicatively coupled to drag members (254) can then send an instruction to increase or decrease pressure of hydraulic members (290) to extend the drag members (254) in different deployed configurations to push the housing away from the wellbore.

Figure 15A:
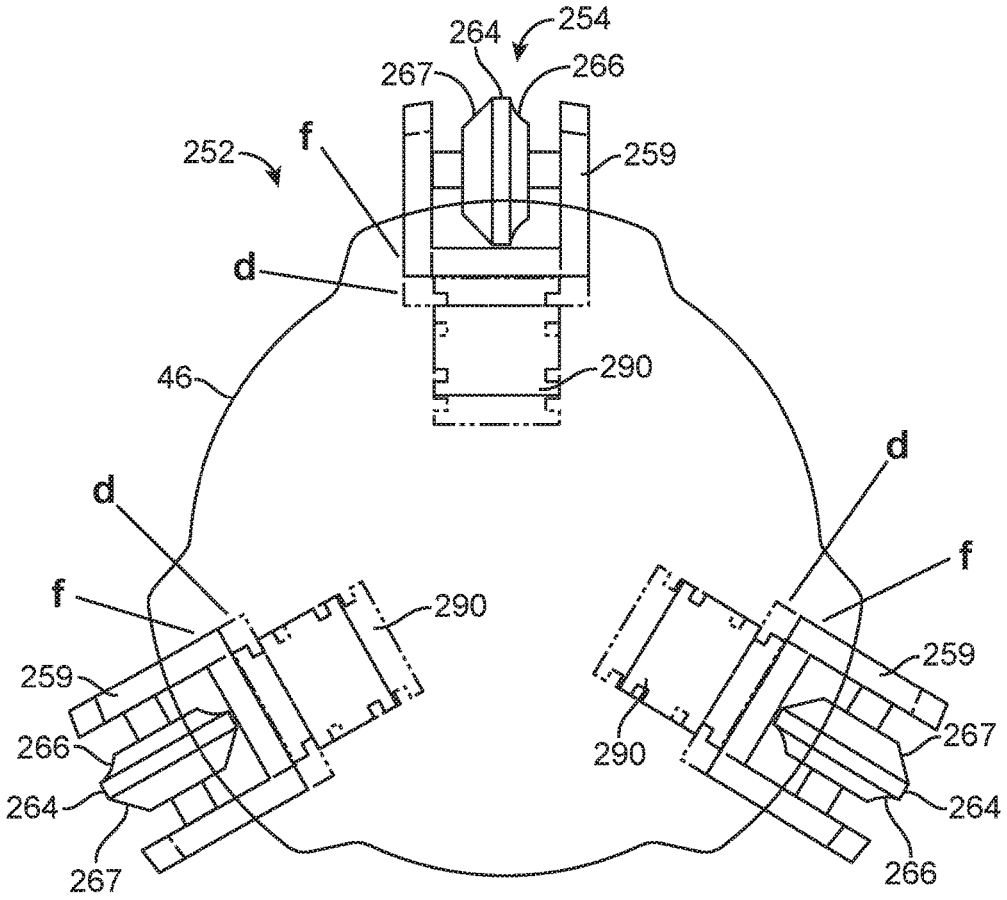
FIG. 15*a* is a cross-sectional view of the anti-rotation device of FIG. 15 with the drag members further extended to a different settable operational configuration.
Figure 15B:
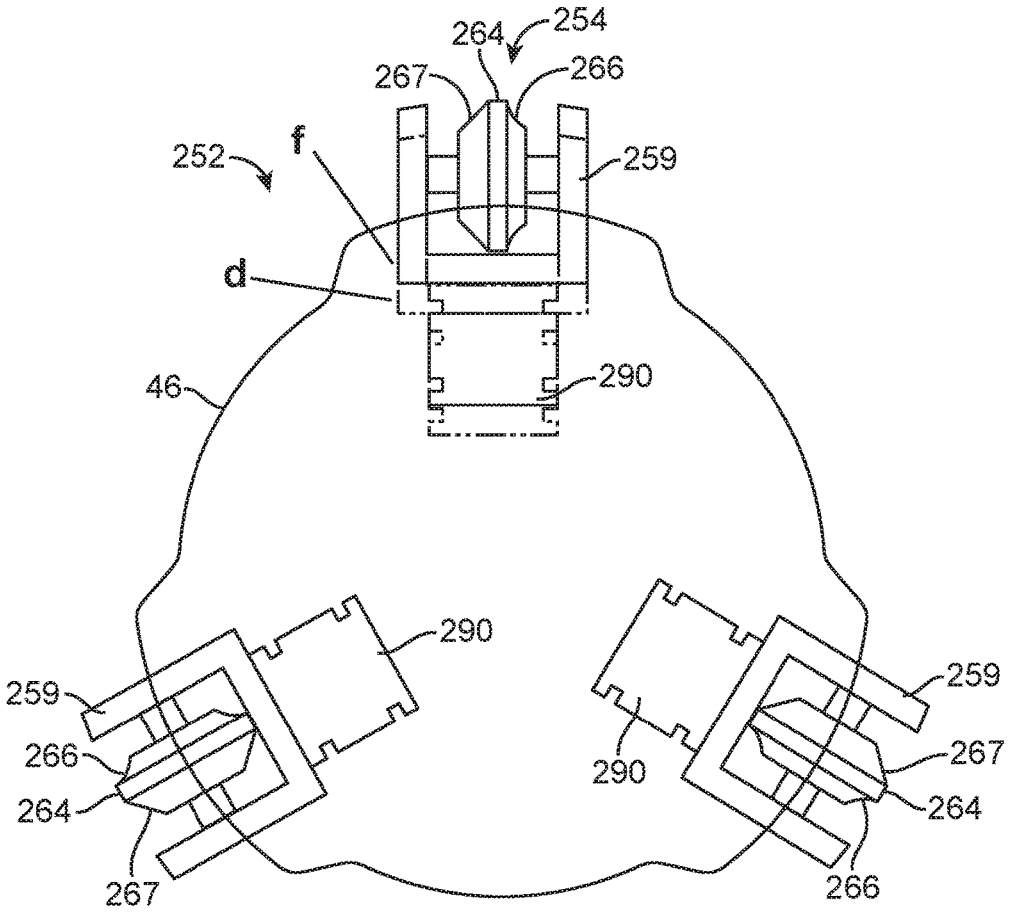
FIG. 15*b* is a cross-sectional view of the anti-rotation device of FIG. 15 with drag members extended different lengths into different deployed configurations.

FIG. 15*b* illustrates different deployed configurations of the frames (259). In particular, one of the hydraulic actuators (290) (the top actuator in the figure) is actuated to deploy one of the drag members (264) to extend from a first position "e" to a second, deployed position "f" thus extending closer to the wellbore wall than the other frames (259). In practice, the frame (259) at position "f" would be extended toward the nearby side of the wellbore. This has the effect of applying a greater magnitude of force against the wellbore, and acts to push the housing laterally in the opposite direction.

Accordingly, the force sensors detect the [1] toolface direction of the drill bit (22), as well as the [2] magnitude of the force which the formation exerts on the toolface of the drill bit (22). This information is then sent or received by a controller.

The controller then not only determines the [a] force with which to extend drag members (264), but also [b] the configuration in which to deploy two or more drag members (264). In particular, given that the drill bit (22) deflects toward the wellbore, and the housing (46) and anti-rotation device (252) responsively tilt in the same lateral direction toward the wellbore, it is the drag members on this same side of the wellbore that are radially deployed and extended.

In dependence on this information from the force sensors, the controller determines and then actuates the appropriate sets of drag members needed to counteract or at least partially counteract the force of the wellbore and move the housing away from the wellbore. For example, as noted above, in the illustrated embodiment of FIGS. 6-7, there are three sets (257) of drag members (254) spaced equally about the periphery of the housing (46). Accordingly, in response to the controller determined formation force experienced at the drill bit (22), the controller instructs the different deployable configurations of the sets (257) of drag members (254) which can appropriately counteract the force at the toolface. Moreover, the drag members (254) and different sets of drag members (257) can be deployed in different configurations to exert force at different magnitudes and different radial extension lengths with respect to the longitudinal centerline of the housing, independently one from another. For example, drag members (254) closer to the wellbore can be deployed at greater radial extension lengths and magnitudes of force whereas those on the opposite side are provided with lesser lengths and magnitudes. Accordingly, in some examples, such as where there are three sets (257) of drag members (254), or in other embodiments a plurality of drag members (254), the drag members (254) are deployed in a non-uniform deployment configuration wherein at least two of the drag members (254) have different radial extension lengths or exert different magnitude forces against the wellbore W.

In other embodiments, where there is a greater number of drag members (254) or sets (257) of drag members (254), there can be two or more, three or more, four or more and the like drag members (254) having different radial extension lengths or magnitudes, or a combination where some have the same extension lengths or magnitude and some differing. In other examples, the drag member or members (254) located on the same side of the drill bit (22) on which the formation acts are extended the greatest radial length. In other examples, the drag member (254) which has a radial extension direction generally parallel to the detected toolface direction of the drill bit (22) has the greatest deployment force and/or radial length. However, each set (257), even those on the side opposite the force acting on the drill bit, can be deployed sufficient to extend to the wellbore to assist the prevention of rotation of the housing (46).

Moreover, due to "roll" of the housing (46) during drilling, the sets (257) of deployed drag members (254) must be reconfigured over time. For example, drag members (254) on the side of the housing near to the wellbore may eventually "roll" to the side distanced from the wellbore, and vice-versa. As anyone of the drag members (254) rotates toward the near wellbore side, the magnitude of force exerted should increase, while the magnitude of force of drag members (254) rotating toward the side distanced from the wellbore should decrease. Accordingly, the controller receives information regarding the orientation of the housing and correspondingly configures the deployment of the drag members (254) accordingly. Advantageously, these adjustments can be made continuously, and in real time.

Therefore, a controller is provided to carry out the process described herein. In particular, a controller is provided to receive data from sensors representative of the toolface direction and magnitude of the force on the toolface, determine the appropriate configuration for deployment of the drag members (254), then send instructions to deploy the drag members (254) in different configurations of at least two of the drag members (254) or sets of draft members (254). Accordingly, the controller is communicatively coupled to force sensors that detect the toolface direction and magnitude of formation force acting at the toolface of the drill bit (22) of the rotary steerable drilling device (20). The controller is also communicatively coupled to a housing orientation apparatus (364) which has sensors (for example magnetometers and accelerometers) for sensing the orientation of the housing (46) within the wellbore. Based on the sensed information about the formation force on the tool face or the anti-rotation device, and/or the housing orientation of the housing, the controller determines which drag members (254) to deploy to counteract the formation force at the toolface of the drill bit (22), and push the housing (46) back toward center. The controller then sends instructions to the powering mechanism, whether complementary ramps (275, 276), hydraulic members (290) or others, which deploy the drag members (254) or sets (257) of drag members (254) according to the determination of the controller.

The controller or controllers implementing the processes according to the present disclosure can comprise hardware, firmware and/or software, and can take any of a variety of form factors. In particular, the controllers described herein can include at least one processor optionally coupled directly or indirectly to memory elements through a system bus, as well as program code for executing and carrying out processes described herein. A "processor" as used herein is an electronic circuit that can make determinations based upon inputs. A processor can include a microprocessor, a microcontroller, and a central processing unit, among others. While a single processor can be used, the present disclosure can be implemented over a plurality of processors. For example, the plurality of processors can include local controllers of the rotary steerable drilling device, a global controller and/or the surface operator controller, or a single controller can be employed. Accordingly, for purposes of this disclosure, when referring to a controller, it can include a local controller or any other controller or plurality of controllers on the surface, in the drill string or rotary steerable drilling device.

The memory elements can be a computer-usable or computer-readable medium for storing program code for use by or in connection with one or more computers or processors. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. The program code can be software, which includes but is not limited to firmware, resident software, microcode, a Field Programmable Gate Array (FPGA) or Application-Specific Integrated Circuit (ASIC) and the like. Implementation can take the forms of hardware, software or both hardware and software elements. Moreover, the controllers can be communicatively connected, including for example input and output devices coupled either directly or through intervening I/O controllers, or otherwise including connections to the sensors, force sensors, toolface direction sensors, orientation sensors, sensors in the housing orientation apparatus, communication devices, or other components of the rotary steerable unit or drilling shaft deflection device to receive signals, and/or data regarding such components. Moreover, the controllers can also include circuits configured for performing the processes disclosed herein.

Figure 16:
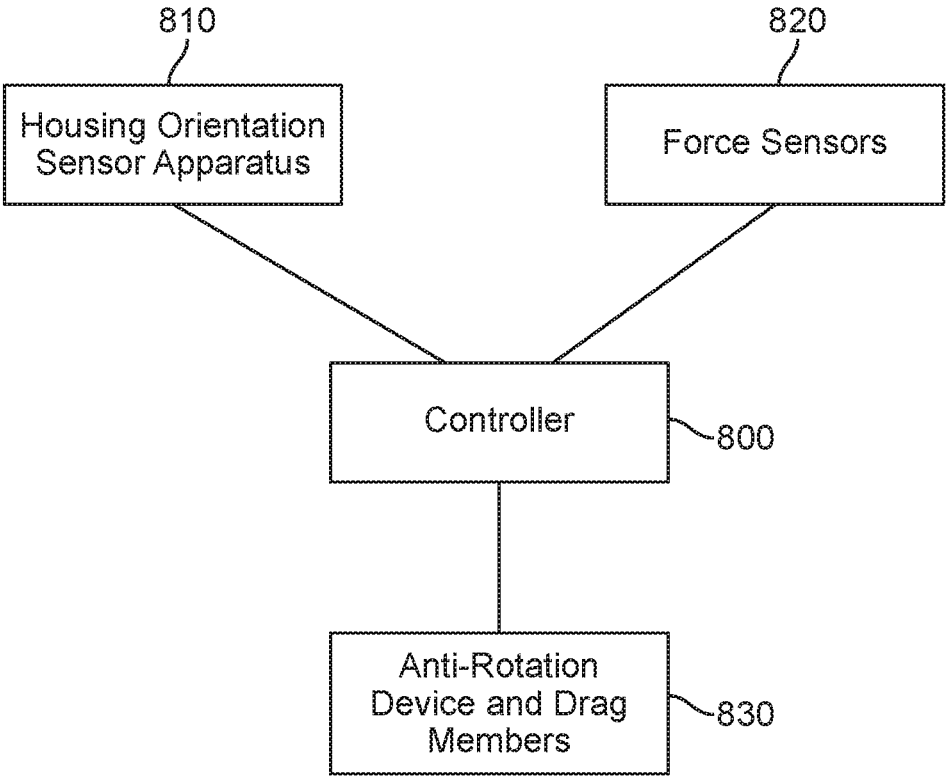
FIG. 16 is a diagram illustrating a configuration for the force counteracting apparatus and process disclosed herein.

An exemplary diagram of the controller, its process and communication is illustrated in FIG. 16. The controller is shown at block 800 that is communicatively coupled to force sensors at block 820 which sense the direction of the toolface, as well as the magnitude of the force on the toolface of the drill bit, and/or the force at the anti-rotation device. Additionally, the controller is communicatively coupled to Housing Orientation Apparatus at block 810, which senses the orientation of the housing. Information on the force at the toolface and/or the anti-rotation device is provide to the controller at block 800 which then determines the configuration at which to deploy the drag members of the anti-rotation device. The controller 800 then sends instructions to the anti-rotation device and drag members at 830 to deploy the drag members in the determined configuration to counteract the force of the drill bit (22) which causes pivotation and lateral movement of the housing against the wellbore. The force can be sufficient to move the longitudinal axis of the housing of the rotary steerable drill towards alignment with the longitudinal axis of the wellbore, to coincide with the longitudinal axis or move past it. Accordingly, by this process the load at the toolface of the drill bit is enhanced.

Accommodating Different Wellbore Sizes and Formation Types

In drilling operations, the resulting wellbores can have different diameters depending on where and how they were drilled, peculiarities of the site and other drilling factors and requirements. For example, wellbores can have a diameter anywhere from 8 inches to 10 inches, as well as other diameters. Common wellbore sizes range from 8.25 inches to 9 inches. Additionally, different wellbore sites can have differences in the hardness of the formation, some being drilled in hard formations and others being in soft formations. Accordingly, conventional anti-rotational devices cannot adjust for different wellbore sizes or different types of formations.

The anti-rotation device (252) disclosed herein is configurable to provide different deployed lengths for drag members (254). By having different lengths, different wellbores and formation types can be accommodated. In particular, the drag members (254) are deployable in a plurality of operator settable configurations across a borehole engaging range of motion spanning from a start position to a maximally extended, borehole engaging position. Moreover, for at least two of the plurality of settable operational configurations, the start position of the borehole engaging range of motion is different. These configurations can be carried out by an operator manually or automatically using a controller discussed above.

Accordingly, as disclosed herein, the drag members (254) are operator configurable to extend to various set radial extension lengths depending on the [1] size or diameter of the wellbore, and [2] the desired magnitude of force. The operator can choose amongst a plurality of settable operational configurations where each configuration sets different extension lengths of drag members (254) depending on the size of the wellbore. Further, depending on whether the formation is hard or soft, the radial extension length can be adjusted to have the desired magnitude of force. Therefore, the deployed radial length of drag members (254) can be increased such that the springs are compressed to provide a large magnitude of force, or decreased such that springs are expanded to provide a smaller force magnitude of the springs (262). As a result, in soft formations the smaller force can be employed so that the drag members (254) do not penetrate too far into the formation, and in hard formations, the drag members (254) are employed with a larger force to assure less slippage over the wellbore wall.

Accordingly, in larger sized wellbores with hard formations, the operator can configure the drag members (254) to be deployed with a longer extension in order to accommodate the large sized wellbore while also compressing the springs (262) a greater amount. This permits the rotary steerable drill to be used in a larger wellbore while also allowing a greater magnitude of force and penetration by the drag members (254). If the larger wellbore has a soft formation, the drag members (254) are configured to extend a lesser amount than in the hard formation so that the springs (262) are expanded more and less compressed, thus reducing the magnitude of force provided by the springs (262). Further, in smaller wellbores, with soft formations, the operator can configure the drag members (254) to be deployed with a shorter extension so as to accommodate the smaller wellbore while also avoiding compressing the springs (262) to a large degree. On the other hand, if the smaller wellbore has a hard formation, the drag members (254) can be radially extended a longer length in order to more highly compress the springs (262). Accordingly, in this way, the anti-rotation device (252) can accommodate larger and smaller wellbores as well as formation types.

This can be seen with reference to FIGS. 6*a* and 6*b*, which show frames (258) extended to two different settable operational configurations. In particular, the frames (258) and drag members (254) are uniformly extendable between one starting operational configuration "a," and a second starting operational configuration "b," wherein in configuration "b," the drag members are extended further than in configuration "a." Accordingly, the deployed configuration "a" of FIG. 6*a* can be used for example in smaller wellbores and/or softer formations, whereas the deployed configuration "b" can be used in larger wellbores or with harder formations.

Accordingly, in practice, if for example in position "a" the drag members (254) form an 8 inch diameter circumference, they could be extended and placed in an 8.25 inch wellbore. Accordingly, this 8 inch diameter can be considered a start position. They can then be further extended until they engage the wall of the borehole. Once the borehole wall is engaged, the drag members (254) can be further extended to compress springs (262) and increase the magnitude of force. Alternatively, the drag members (254) can be set to the start configuration "a" and then placed in an 8.25 inch wellbore, which immediately compresses the springs (262) to provide an increased magnitude of force on the formation wellbore. Correspondingly, if in start configuration "b" the drag members together formed a circumference of 8.5 inches, they could be placed in a 9 inch wellbore, and further extended until they start to contact or engage the wall of the borehole. They can be further deployed from the borehole wall engaging position to increase spring pressure. Alternatively, the drag members (254) in configuration "b" can be placed in an 8.5 inch wellbore, wherein the springs (262) compress and provide greater force.

The same is also illustrated in a cross-sectional perspective in FIGS. 7*a* and 15*a*. For example, the frames (259) and drag members (254) are extendable between one starting operational configuration "e," and a second starting operational configuration "f," wherein in configuration "f" the drag members are extended further than that in configuration "e." Accordingly, the deployed configuration "e" of FIGS. 7*a* and 15*a* can be used for example in smaller wellbores and/or softer formations, whereas the deployed configuration "f" can be used in larger wellbores or with harder formations.

Figure 6D:
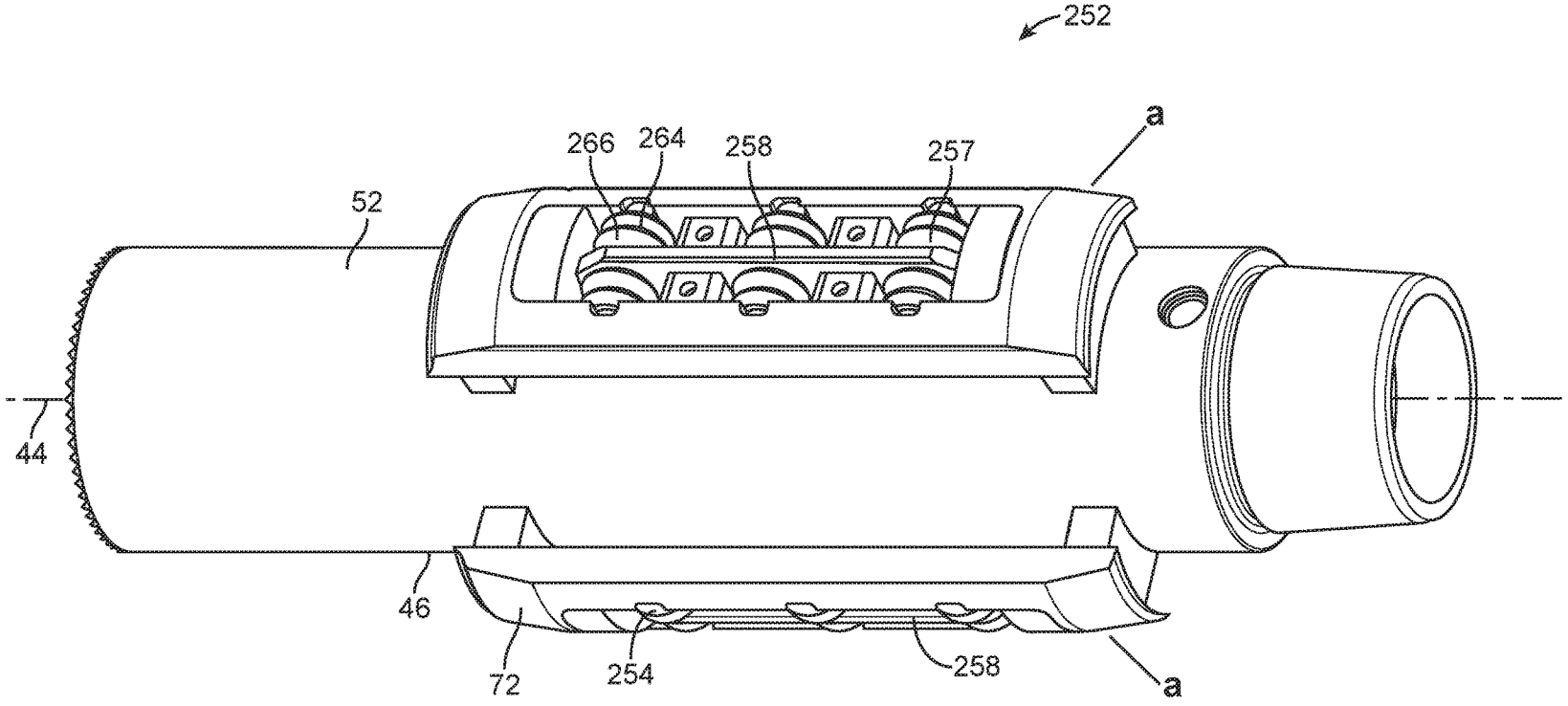
FIG. 6*d* is a perspective side view of an anti-rotation device with movable frames extended into a first settable starting operational configuration.
Figure 6E:
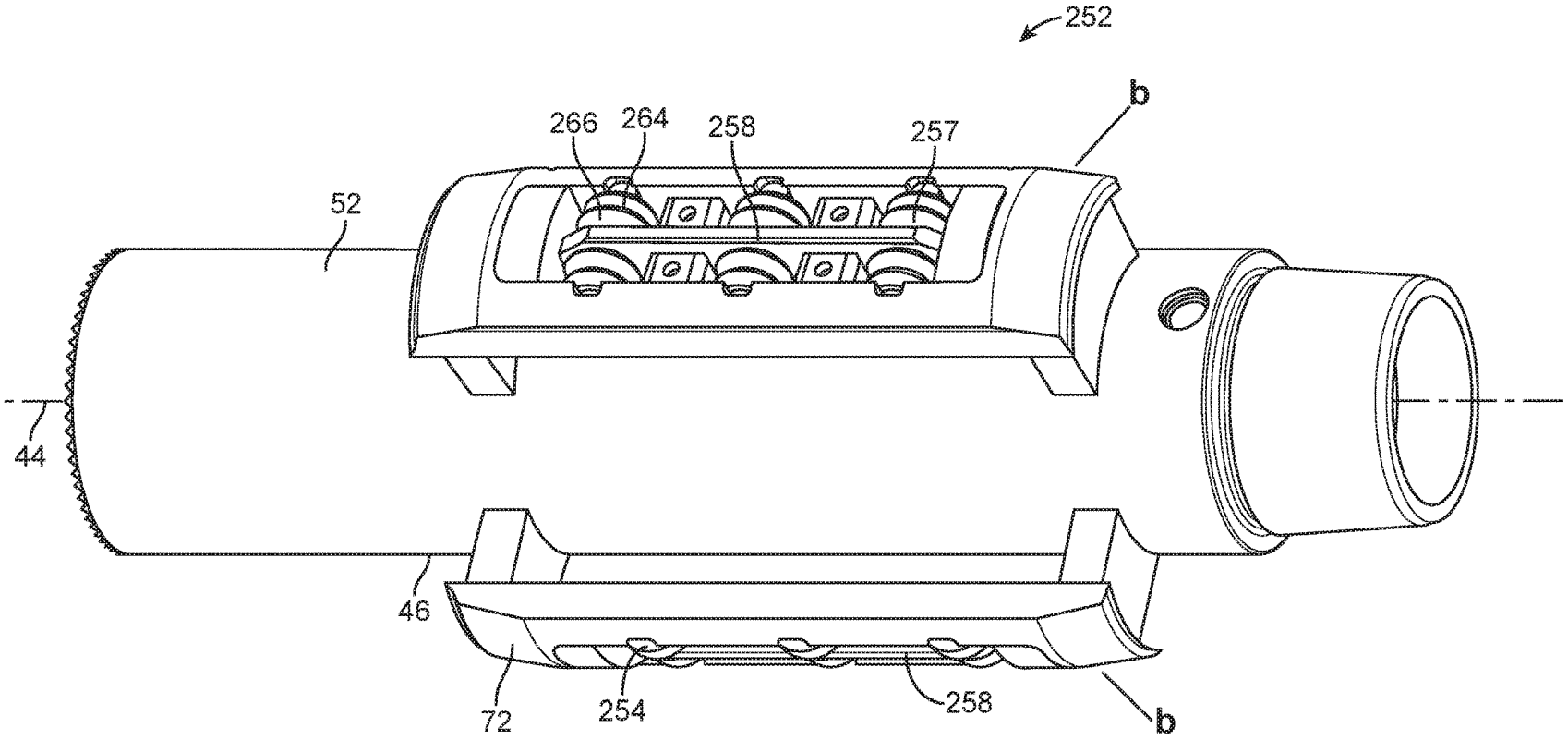
FIG. 6*e* is a perspective side view of an anti-rotation device with movable frames extended further, to a different first settable starting operational configuration.
Figure 6F:
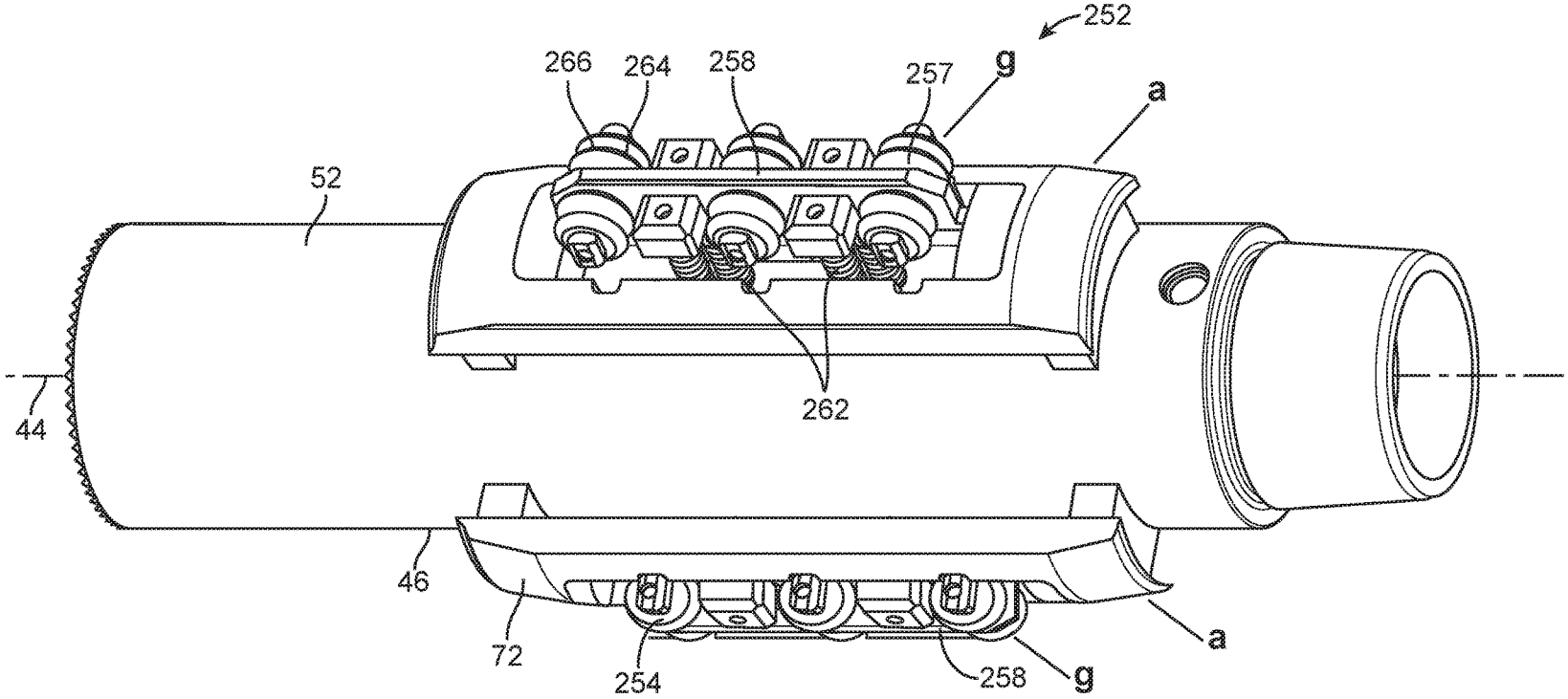
FIG. 6*f* is a perspective side view of an anti-rotation device with movable frames extended to a first settable starting operational configuration as in FIG. 6*d*, but with drag members also deployed.
Figure 6G:
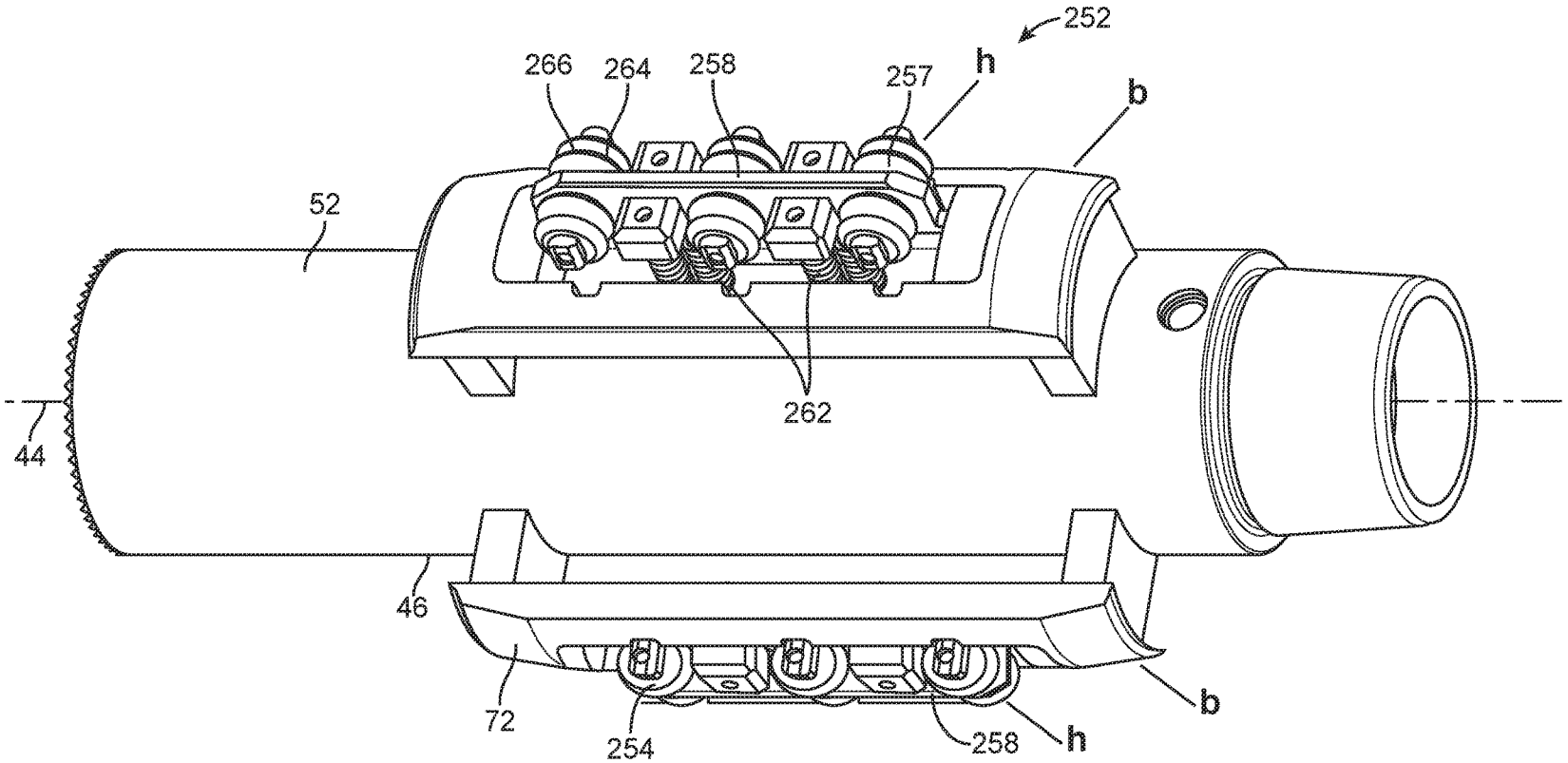
FIG. 6*g* is a perspective side view of an anti-rotation device with movable frames extended out further to a first settable starting operational configuration as in FIG. 6*e*, and also with the drag members deployed.

In additional embodiments, the movable platforms or risers (72) {also referred to simply as frames in this portion of the description, in contrast to carriage frames (258) upon which the drag members (254) are mounted for rotation} can be deployed to a settable starting configuration "a" shown in FIG. 6*d*, or a settable starting configuration "b" shown in FIG. 6*e*, where the movable risers (72) are extended out a further distance in configuration "b" than in configuration "a." From these configurations, the carriage frames (258) and drag members (254) thereon can be deployed to engage the wellbore wall. For example, configuration "a" can be used for a smaller wellbore. In configuration "a" that forms an 8 inch diameter anti-rotation device (252) using a plurality of movable platforms or risers (72), the anti-rotation device (252) can be placed in a 8.25 inch wellbore. The drag members (254) can then be deployed to contact or engage the borehole. The example in FIG. 6*f* illustrates the deployment of drag members (254) to configuration "g," which can be for example, 8.25 inches, thus engaging the wellbore. In the example of FIG. 6*g*, configuration "b" can be used for larger wellbores. If configuration "b" forms an 8.5 inch diameter anti-rotation device (252) by elevating the plurality of platforms or risers (72), it can be suitable for placement in a 9 inch wellbore. The drag members (254) can then be deployed to contact or engage the borehole. FIG. 6*g* illustrates the deployment of drag members (254) to configuration "h," which can be for example 9 inches thus engaging the wellbore. In either case, the movable platforms or risers (72) could be extended further out to compress the springs (262) and create greater force against the wellbore.

In view of the above, the drag members (254) can have a plurality of different operational configurations to accommodate differently sized boreholes. Accordingly, for at least two of the plurality of settable operational configurations, the start position of the borehole engaging range of motion is different. For example, for a borehole that is 8.25 inches, the drag members (254) can be set at a distance or length that establishes an anti-rotation device (252) having an 8 inch circumference, and can then further increase or decrease to change the magnitude of force of the springs (262). However, the same rotary steerable drilling device (20) and anti-rotation device (252) can be placed in another borehole that is 9 inches in diameter if the drag members (254) are set to establish an 8.5 inch diameter anti-rotation device (252). Additionally, the lengths can be further increased or decreased to change the magnitude of force of the springs (262). This same rotary steerable drilling device (20) and anti-rotation device (252) can then be used in different sized diameter wellbore and be employed at a different set configuration.

The drag members can be extended the same radial distance from the centerline of the housing (46) in order to form an approximate circumference having a particular diameter for the anti-rotation device (252). In some examples, the drag members (254) are configurable to accommodate wellbores across a range of sizes; for example, from 5 to 15 inches, alternatively from 6 to 13 inches, alternatively from 7 to 12 inches, alternatively from 8 to 9 inches, alternatively from 8.125 to 8.875 inches, alternatively from 8.25 to 8.75 inches, alternatively from 8.33 to 8.66 inches, alternatively from 8.4 inches to 8.6 inches, alternatively from 8.4 to 8.5 inches, or any combination of the aforementioned diameters, or infinite positions therebetween, as measured in diameter formed by the extending drag members (254) from the longitudinal centerline (44) housing (46).

As discussed previously, the different degrees or lengths of compression of springs (262) provide different magnitudes of force exerted by the springs (262). For example, at maximum expansion (i.e. minimum compression), the springs (262) may only exert 800 lbs/sq inch, whereas at minimum expansion (i.e. maximum compression), the springs (262) can exert 2000 lbs/sq inch. The magnitude of force exerted by the springs is not limiting, and can have any maximum or minimum force, including for example, 200 to 4000 lbs/sq inch, 400 to 3500 lbs/sq inch, 600 to 3000 lbs/sq inch, 700 to 2500 lbs/sq inch, 900 to 1800 lbs/sq inch, 1000 to 1500 lbs/sq inch, or any combination of the aforementioned. The magnitude range of force which the springs (262) exert can be such that they will be appropriate for a broad range of wellbore diameters and formation types.

The drag members (254) can be extended by use of complementary surfaces (275, 276) or hydraulic members (290), or any other powering mechanism. Further, a controller can be communicatively coupled to the drag members (254) or a moveable frame such as carriage assembly (258) to deploy and extend drag members (254). The drag members (254) can be extended directly or by the movement of a moveable frame, such as carriage frames (258) upon which they are mounted. Accordingly, the carriage frames (258) have a plurality of different settable positions, each different settable position of the movable frame corresponding to one of the plurality of settable operational configurations of the drag members (254).

Accordingly, the frames (258), can be extended, retracted, or moved to accommodate the various start positions, and deployable configurations of the drag members (254) for different sized wellbores and formation types. Therefore, the frames (258) can be moved to a plurality of settable positions, where at least two different settable positions move the frames (258) a different radial distance from the longitudinal centerline of the housing (46). Moreover, in order to maintain an equal diameter formed by the extending drag members (254), each carriage assembly (258) can be spaced the same radial distance from the longitudinal centerline of the housing (46).

The embodiments shown and described above are only examples. Many details are often found in the art such as the other features of a rotary steerable drilling systems, and particularly anti-rotation devices used in such systems. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A rotary steerable subterranean drill capable of establishing a deflection angle and azimuthal toolface direction of a drill bit, the rotary steerable subterranean drill, comprising:

a housing;

an anti-rotation device positioned at an exterior of the housing and comprising a plurality of differently configurable, radially deployable drag members that are peripherally spaced about the exterior of the housing;

a controller coupled to the plurality of drag members and which is configured to instruct different deployed configurations of at least two of the drag members in dependence upon a controller-determined formation force experienced on a drill bit of the rotary steerable subterranean drill; and a sensor configured to detect a toolface direction of the drill bit and a magnitude of a formation force acting on the drill bit, the sensor having an output that is configured to output data representative of the detected toolface direction of the drill bit and the detected magnitude of the formation force acting on the drill bit;

wherein the controller is configured to instruct a greatest radial extension length of a deployable drag member that has a radial extension direction generally parallel to the detected toolface direction of the drill bit.

2. The rotary steerable subterranean drill of claim 1, further comprising:

a drilling configuration of the rotary steerable subterranean drill in which at least two of the drag members have different magnitude deployment forces against a surrounding formation.

3. The rotary steerable subterranean drill of claim 1, further comprising:

a drilling shaft that is rotatably supported in the housing and wherein the drilling shaft and the housing are each substantially cylindrical shaped and have a longitudinal centerline.

4. The rotary steerable subterranean drill of claim 3, further comprising:

a drilling configuration of the rotary steerable subterranean drill in which at least two of the drag members have different radial extension lengths relative to the longitudinal centerline of the housing.

5. The rotary steerable subterranean drill of claim 4, wherein, in the drilling configuration of the rotary steerable subterranean drill, at least two of the drag members have different magnitude deployment forces against a surrounding formation.

6. The rotary steerable subterranean drill of claim 1, wherein the controller further comprises an input configured to receive output data from the sensor that is representative of the detected toolface direction of the drill bit and the detected magnitude of the formation force acting on the drill bit, and in dependence thereupon, the controller is configured to determine the different deployed configurations of at least two of the drag members.

7. The rotary steerable subterranean drill of claim 6, wherein the controller is configured to instruct non-uniform deployment of the plurality of radially deployable drag members that at least partially counteracts the detected formation force acting on the drill bit.

8. The rotary steerable subterranean drill of claim 7, wherein the controller is configured to instruct a greatest deployment force by at least one deployable drag member that has a radial extension direction generally parallel to the detected toolface direction of the drill bit.

9. The rotary steerable subterranean drill of claim 1, wherein the deployable drag member having the greatest radial extension length is located on the same side of the rotary steerable subterranean drill upon which the formation force acts.

10. The rotary steerable subterranean drill of claim 3, further comprising:

a drilling shaft deflection assembly contained within the housing and comprising an outer eccentric ring and an inner eccentric ring that engages the drilling shaft; and a pair of bi-directional drive motors anchored relative the housing and respectively coupled, one each, to the inner and outer eccentric rings for rotating each eccentric ring in two directions.

11. The rotary steerable subterranean drill of claim 10, further comprising:

the longitudinal centerlines of the drilling shaft and housing being substantially coincident when the drilling shaft is undeflected within the housing;

the drilling shaft deflection assembly configured to transition the drilling shaft between deflected and undeflected configurations;

the outer eccentric ring being rotatably supported at an inner peripheral surface of the housing and having a circular inner peripheral surface that is eccentric with respect to the housing;

the inner eccentric ring being rotatably supported at the circular inner peripheral surface of the outer eccentric ring and having a circular inner peripheral surface that engages the drilling shaft and which is eccentric with respect to the circular inner peripheral surface of the outer eccentric ring; and one of the pair of motors drivingly coupled by a first transmission to the outer eccentric ring and which rotates the outer eccentric ring in a first direction and an opposite, second direction relative to the housing and the other of the pair of motors drivingly coupled by a second transmission to the inner eccentric ring and which rotates the inner eccentric ring in a first direction and an opposite, second direction relative to the outer eccentric ring.

12. The rotary steerable subterranean drill of claim 11, wherein each of the pair of drive motors is an electronically commutated motor.

13. The rotary steerable subterranean drill of claim 12, wherein each of the electronically commutated motors is a brushless direct current motor.

14. A method for determining a configuration of an anti-rotation device of a rotary steerable subterranean drill in a drilling configuration, the method comprising:

detecting, at a sensor, a toolface direction of a drill bit and a magnitude of a formation force acting on the drill bit of a rotary steerable subterranean drill, wherein the rotary steerable subterranean drill comprises a housing, an anti-rotation device positioned at an exterior of the housing, and the anti-rotation device comprising a plurality of differently configurable, radially deployable drag members that are peripherally spaced about the exterior of the housing;

receiving, at a controller, from the sensor, data representative of the detected toolface direction of the drill bit and the detected magnitude of the formation force acting on the drill bit;

determining, at the controller, in dependence upon the received data representative of the detected toolface direction of the drill bit and the detected magnitude of a formation force acting on the drill bit, an instruction that differently configures the plurality of differently configurable, radially deployable drag members; and issuing, from the controller, the instruction and thereby configuring the rotary steerable subterranean drill into a corresponding drilling configuration in which the radially deployable drag members are differently configured; and causing a greatest radial extension length in a deployable drag member that has a radial extension direction generally parallel to the detected toolface direction of the drill bit.

15. The method of claim 14, wherein, in the established drilling configuration, at least two of the drag members exert different magnitude deployment forces against a surrounding formation.

16. The method of claim 14, wherein, in the established drilling configuration, at least two of the drag members have different radial extension lengths relative to a longitudinal centerline of the housing.

17. The method of claim 14, further comprising:

non-uniformly deploying the plurality of radially deployable drag members and thereby at least partially counteracting the detected formation force acting on the drill bit.

18. A rotary steerable subterranean drill capable of establishing a deflection angle and azimuthal toolface direction of a drill bit, the rotary steerable subterranean drill, comprising:

a housing;

an anti-rotation device positioned at an exterior of the housing and comprising a plurality of differently configurable, radially deployable drag members that are peripherally spaced about the exterior of the housing;

a controller coupled to the plurality of drag members and which is configured to instruct different deployed configurations of at least two of the drag members in dependence upon a controller-determined formation force experienced on a drill bit of the rotary steerable subterranean drill; and a sensor configured to detect a toolface direction of the drill bit and a magnitude of a formation force acting on the drill bit, the sensor having an output that is configured to output data representative of the detected toolface direction of the drill bit and the detected magnitude of the formation force acting on the drill bit;

wherein the controller is configured to instruct non-uniform deployment of the plurality of radially deployable drag members that at least partially counteracts the detected formation force acting on the drill bit.

19. The rotary steerable subterranean drill of claim 18, further comprising:

a drilling shaft that is rotatably supported in the housing and wherein the drilling shaft and the housing are each substantially cylindrical shaped and have a longitudinal centerline; and a fulcrum bearing configured to cause the pivoting of the drilling shaft upon deflection of the drilling shaft to produce a bending or curvature of the drilling shaft.

* * * * *